US012410494B2

(12) United States Patent
Zhang et al.

(10) Patent No.: US 12,410,494 B2
(45) Date of Patent: Sep. 9, 2025

(54) METHOD FOR SYNTHESIZING INTERMETALLIC ALLOY NANOPARTICLES

(71) Applicant: City University of Hong Kong, Hong Kong (HK)

(72) Inventors: Hua Zhang, Hong Kong (HK); Biao Huang, Hong Kong (HK); Yiyao Ge, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 445 days.

(21) Appl. No.: 18/182,357

(22) Filed: Mar. 12, 2023

(65) Prior Publication Data

US 2024/0301534 A1 Sep. 12, 2024

(51) Int. Cl.

| | |
|---|---|
| ***C22C 5/04*** | (2006.01) |
| ***C22C 1/047*** | (2023.01) |
| ***C22C 13/00*** | (2006.01) |
| ***C25B 3/23*** | (2021.01) |
| ***C25B 11/046*** | (2021.01) |

(52) U.S. Cl.

CPC ..... *C22C 13/00* (2013.01); *C22C 1/047* (2023.01); *C22C 5/04* (2013.01); *C25B 3/23* (2021.01); *C25B 11/046* (2021.01)

(58) Field of Classification Search

CPC ..... B82Y 40/00; B22F 1/054; B22F 1/0553; B22F 9/24; C22C 5/04; C25B 3/23; C25B 11/046

See application file for complete search history.

(56) References Cited

U.S. PATENT DOCUMENTS

2021/0016355 A1* 1/2021 Chen ..... B22F 9/24
2021/0399328 A1 12/2021 Hosseini-Benhangi et al.

OTHER PUBLICATIONS

Leigang Li et al. Metallic nanostructures with low dimensionality for electrochemical water splitting. Chem. Soc. Rev. 2020, 49, 3072-3106.
Ye Chen et al. Two-Dimensional Metal Nanomaterials: Synthesis, Properties, and Applications. Chem. Rev. 2018, 118, 6409-6455.
Lingzheng Bu et al. Biaxially strained PtPb/Pt core/shell nanoplate boosts oxygen reduction catalysis. Science, 2016, 354(6318), 1410-1414.
Yifeng Shi et al. Noble-Metal Nanocrystals with Controlled Shapes for Catalytic and Electrocatalytic Applications. Chem. Rev. 2021, 121, 649-735.
Chengzhou Zhu et al. Engineering Ordered and Nonordered Porous Noble Metal Nanostructures: Synthesis, Assembly, and Their Applications in Electrochemistry. Chem. Rev. 2015, 115, 8896-8943.
Tianou He et al. Mastering the surface strain of platinum catalysts for efficient electrocatalysis. Nature, 2021, 598, 76-81.
Mingchuan Luo et al. PdMo bimetallene for oxygen reduction catalysis. Nature, 2019, 574, 81-85.
Xiaoqing Huang et al. High-performance transition metal-doped Pt3Ni octahedra for oxygen reduction reaction. Science, 2015, 348(6240), 1230-1234.
Xinlong Tian et al. Engineering bunched Pt—Ni alloy nanocages for efficient oxygen reduction in practical fuel cells. Science, 2019, 366, 850-856.
Lei Zhang et al. Platinum-based nanocages with subnanometer-thick walls and well-defined, controllable facets. Science, 2015, 349(6246), 412-416.
Ming Zhou et al. Noble-Metal Based Random Alloy and Intermetallic Nanocrystals: Syntheses and Applications. Chem. Rev. 2021, 121, 736-795.
Kyle D. Gilroy et al. Bimetallic Nanocrystals: Syntheses, Properties, and Applications. Chem. Rev. 2016, 116, 10414-10472.
Ryong Ryoo et al. Rare-earth-platinum alloy nanoparticles in mesoporous zeolite for catalysis. Nature, 2020, 585, 221-224.
Tung-Han Yang et al. Noble-Metal Nanoframes and Their Catalytic Applications. Chem. Rev. 2021, 121, 796-833.
Jiangyan Wang et al. Hollow Multishelled Structures for Promising Applications: Understanding the Structure—Performance Correlation. Acc. Chem. Res. 2019, 52, 2169-2178.
Chen Chen et al. Highly Crystalline Multimetallic Nanoframes with Three-Dimensional Electrocatalytic Surfaces. Science, 2014, 343, 1339-1343.
Ye Chen et al. Phase engineering of nanomaterials. Nature Reviews Chemistry, 2020, 4, 243-256.
Yiyao Ge et al. Two-Dimensional Nanomaterials with Unconventional Phases. Chem 6, 2020, 1237-1253.
Shiyao Lu et al. Crystal Phase Control of Gold Nanomaterials by Wet-Chemical Synthesis. Acc. Chem. Res. 2020, 53, 2106-2118.
Hongfei Cheng et al. Syntheses and Properties of Metal Nanomaterials with Novel Crystal Phases. Adv. Mater. 2018, 30, 1707189.
Yiyao Ge et al. Preparation of fcc-2H-fcc Heterophase Pd@Ir Nanostructures for High-Performance Electrochemical Hydrogen Evolution. Adv. Mater. 2022, 34, 2107399.
Wu Tong et al. Crystal-Phase-Engineered PdCu Electrocatalyst for Enhanced Ammonia Synthesis. Angew. Chem. 2020, 132, 2671-2675.

(Continued)

*Primary Examiner* — Jessee R Roe
(74) *Attorney, Agent, or Firm* — Idea Intellectual Limited; Sam T. Yip

(57) ABSTRACT

A general and well-controlled method for synthesizing intermetallic nanoparticles is provided. The method comprises: preparing noble-metal nanoparticle seeds; dispersing a metal precursor into the noble-metal nanoparticle seeds to form a first solution; adding the first solution into an organic solvent to form a first mixture; sonicating the first mixture at room temperature; subjecting the first mixture to a heat treatment under $N_2$ atmosphere to render a second solution; cooling the second solution naturally to room temperature; adding ethanol to the second solution to form a third solution; and collecting the intermetallic nanoparticle from the third solution by centrifugation. The as-synthesized hollow orthorhombic $Pd_2Sn$ alloy nanoparticles can accelerate the cleavage of C—C bond when compared with commercial Pd/C and display superior catalytic performance towards glycerol oxidation reaction and potential for promising applications.

17 Claims, 20 Drawing Sheets

(56) References Cited

OTHER PUBLICATIONS

Jingjie Ge et al. Ultrathin Amorphous/Crystalline Heterophase Rh and Rh Alloy Nanosheets as Tandem Catalysts for Direct Indole Synthesis. Adv. Mater. 2021, 33, 2006711.
Yiyao Ge et al. Seeded Synthesis of Unconventional 2H-Phase Pd Alloy Nanomaterials for Highly Efficient Oxygen Reduction. J. Am. Chem. Soc. 2021, 143, 17292-17299.
Hongfei Cheng et al. Aging amorphous/crystalline heterophase PdCu nanosheets for catalytic reactions. Natl Sci Rev, 2019, 6(5), 955-961.
Junrui Li et al. Intermetallic Nanoparticles: Synthetic Control and Their Enhanced Electrocatalysis. Acc. Chem. Res. 2019, 52, 2015-2025.
Yucong Yan et al. Intermetallic Nanocrystals: Syntheses and Catalytic Applications. Adv. Mater. 2017, 29, 1605997.
Lin Jia et al. Phase-Dependent Electrocatalytic CO2 Reduction on Pd3Bi Nanocrystals. Angew. Chem. 2021, 133, 21909-21913.
Ying Zhang et al. Rhombohedral Pd—Sb Nanoplates with Pd-Terminated Surface: An Efficient Bifunctional Fuel-Cell Catalyst. Adv. Mater. 2022, 34, 2202333.
Cheng-Long Yang, et al. Sulfur-anchoring synthesis of platinum intermetallic nanoparticle catalysts for fuel cells. Science, 2021, 374, 459-464.
Qinbai Yun et al. Synthesis of PdM (M=Zn, Cd, ZnCd) Nanosheets with an Unconventional Face-Centered Tetragonal Phase as Highly Efficient Electrocatalysts for Ethanol Oxidation. ACS Nano, 2019, 13, 14329-14336.
Ming Zhou et al. Synthesis of Pd3Sn and PdCuSn Nanorods with L12 Phase for Highly Efficient Electrocatalytic Ethanol Oxidation. Adv. Mater. 2022, 34, 2106115.
Wen Chen et al. High-Entropy Intermetallic PtRhBiSnSb Nanoplates for Highly Efficient Alcohol Oxidation Electrocatalysis. Adv. Mater. 2022, 34, 2206276.
Minda Chen et al. Thermal Unequilibrium of PdSn Intermetallic Nanocatalysts: From In Situ Tailored Synthesis to Unexpected Hydrogenation Selectivity. Angew. Chem. 2021, 133, 18457-18465.
Lingzheng Bu et al. Coupled s-p-d Exchange in Facet-Controlled Pd3Pb Tripods Enhances Oxygen Reduction Catalysis. Chem 4, 2018, 359-371.
Hongpan Rong et al. Kinetically Controlling Surface Structure to Construct Defect-Rich Intermetallic Nanocrystals: Effective and Stable Catalysts. Adv. Mater. 2016, 28, 2540-2546.
Yiyao Ge et al. Phase-Selective Epitaxial Growth of Heterophase Nanostructures on Unconventional 2H—Pd Nanoparticles. J. Am. Chem. Soc. 2020, 142, 18971-18980.
Qiang Gao et al. Monodisperse PdSn/SnOx core/shell nanoparticles with superior electrocatalytic ethanol oxidation performance. J. Mater. Chem. A, 2020, 8, 20931-20938.
Claudio Bianchini et al. Palladium-Based Electrocatalysts for Alcohol Oxidation in Half Cells and in Direct Alcohol Fuel Cells. Chemical Reviews, 2009, 109(9), 4183-4206.
Rubén Rizo et al. Pt-Richcore/Sn-Richsubsurface/Ptskin Nanocubes as Highly Active and Stable Electrocatalysts for the Ethanol Oxidation Reaction. J. Am. Chem. Soc. 2018, 140, 3791-3797.
Nailiang Yang et al. Synthesis of Ultrathin PdCu Alloy Nanosheets Used as a Highly Efficient Electrocatalyst for Formic Acid Oxidation. Adv. Mater. 2017, 29, 1700769.
Suping Li et al. Designed multimetallic Pd nanosponges with enhanced electrocatalytic activity for ethylene glycol and glycerol oxidation. Energy Environ. Sci. 2016, 9, 3097-3102.
You Xu et al. Integrating electrocatalytic hydrogen generation with selective oxidation of glycerol to formate over bifunctional nitrogen-doped carbon coated nickel-molybdenum-nitrogen nanowire arrays. Applied Catalysis B: Environmental. 2021, 298, 120493.
Youngmin Kim et al. The Role of Ruthenium on Carbon-Supported PtRu Catalysts for Electrocatalytic Glycerol Oxidation under Acidic Conditions. ChemCatChem, 2017, 9, 1683-1690.
Jocelyn T. L. Gamler et al. Random Alloyed versus Intermetallic Nanoparticles: A Comparison of Electrocatalytic Performance. Adv. Mater. 2018, 30, 1801563.
Kai Wang et al. Vertex-Type Engineering of Pt—Cu—Rh Heterogeneous Nanocages for Highly Efficient Ethanol Electrooxidation. Adv. Mater. 2018, 30, 1804074.
Chang-Yi Wang et al. Intermetallic PtBi Nanoplates with High Catalytic Activity towards Electro-oxidation of Formic Acid and Glycerol. ChemElectroChem, 2020, 7, 239-245.
Mário Simões et al. Electro-oxidation of glycerol at Pd based nano-catalysts for an application in alkaline fuel cells for chemicals and energy cogeneration. Applied Catalysis B: Environmental. 2010, 93, 354-362.
J.F. Gomes et al. Influence of silver on the glycerol electro-oxidation over AuAg/C catalysts in alkaline medium: a cyclic voltammetry and in situ FTIR spectroscopy study. Electrochimica Acta. 2014, 144, 361-368.
Jin-Yi Wang et al. From HCOOH to CO at Pd Electrodes: A Surface-Enhanced Infrared Spectroscopy Study. J. Am. Chem. Soc. 2011, 133, 14876-14879.
Fan Lv et al. Au Clusters on Pd Nanosheets Selectively Switch the Pathway of Ethanol Electrooxidation: Amorphous/Crystalline Interface Matters. Adv. Energy Mater. 2021, 11, 2100187.
Shangqian Zhu et al. Direct Observation on Reaction Intermediates and the Role of Bicarbonate Anions in CO2 Electrochemical Reduction Reaction on Cu Surfaces. J. Am. Chem. Soc. 2017, 139, 15664-15667.
Yi Liu et al. Surfactant-Induced Postsynthetic Modulation of Pd Nanoparticle Crystallinity. Nano Lett. 2011, 11, 1614-1617.
Ming Zhao et al. Pd—Ru Alloy Nanocages with a Face-Centered Cubic Structure and Their Enhanced Activity toward the Oxidation of Ethylene Glycol and Glycerol. Small Methods, 2020, 4, 1900843.
Xichen Zhou et al. Preparation of Au@Pd Core-Shell Nanorods with fcc-2H-fcc Heterophase for Highly Efficient Electrocatalytic Alcohol Oxidation. J. Am. Chem. Soc. 2022, 144, 547-555.
Xiaoyong Mo et al. Direct 3D Printing of Binder-Free Bimetallic Nanomaterials as Integrated Electrodes for Glycerol Oxidation with High Selectivity for Valuable C3 Products. ACS Nano 2022, 16, 12202-12213.
Fang Yang et al. Ultrasmall Pd—Cu—Pt Trimetallic Twin Icosahedrons Boost the Electrocatalytic Performance of Glycerol Oxidation at the Operating Temperature of Fuel Cells. Adv. Funct. Mater. 2020, 30, 1908235.
Hongyuan Shang et al. General synthesis of Pd-pm (pm=Ga, In, Sn, Pb, Bi) alloy nanosheet assemblies for advanced electrocatalysis. Nanoscale, 2020, 12, 3411-3417.
Xuexue Cui et al. Facile growth of ultra-small Pd nanoparticles on zeolite-templated mesocellular graphene foam for enhanced alcohol electrooxidation. Nano Res. 2019, 12(2), 351-356.
Jianping Lai et al. Efficient Bifunctional Polyalcohol Oxidation and Oxygen Reduction Electrocatalysts Enabled by Ultrathin PtPdM (M=Ni, Fe, Co) Nanosheets. Adv. Energy Mater. 2019, 9, 1800684.
Hui Xu et al. Facile construction of fascinating trimetallic PdAuAg nanocages with exceptional ethylene glycol and glycerol oxidation activity. Nanoscale, 2017, 9, 17004-17012.
Lakshmanan Karuppasamy et al. Low- and High-Index Faceted Pd Nanocrystals Embedded in Various Oxygen-Deficient WOx Nanostructures for Electrocatalytic Oxidation of Alcohol (EOA) and Carbon Monoxide (CO). ACS Appl. Mater. Interfaces, 2019, 11, 10028-10041.
Wei Hong et al. Bimetallic PdPt nanowire networks with enhanced electrocatalytic activity for ethylene glycol and glycerol oxidation. Energy Environmental Science, 2015, 8, 2910-2915.
Hui Xu et al. Sophisticated Construction of Binary PdPb Alloy Nanocubes as Robust Electrocatalysts toward Ethylene Glycol and Glycerol Oxidation. ACS Appl. Mater. Interfaces, 2018, 10, 12659-12665.
Junfeng Liu et al. PdMoSb trimetallene as high-performance alcohol oxidation electrocatalyst. Nano Res. 2022, https://doi.org/10.1007/s12274-022-4873-8.
A. Zalineeva et al. Glycerol electrooxidation on self-supported Pd1Snx nanoparticules. Applied Catalysis B: Environmental, 2015, 176-177, 429-435.

(56) References Cited

OTHER PUBLICATIONS

P. Hosseini-Benhangi et al. The carbon dioxide redox flow battery: Bifunctional CO2 reduction/formate oxidation electrocatalysis on binary and ternary catalysts. Journal of Power Sources, 2021, 495, 229752.
Shinya Furukawa et al. Bifunctional Catalytic System Effective for Oxidative Dehydrogenation of 1-Butene and n-Butane Using Pd-Based Intermetallic Compounds. ACS Catal. 2014, 4, 3533-3542.
Siniya Mondal et al. Bifunctional Electrocatalytic Activity of Ordered Intermetallics Based on Pd and Sn. J. Phys. Chem. C, 2020, 124, 9631-9643.

* cited by examiner

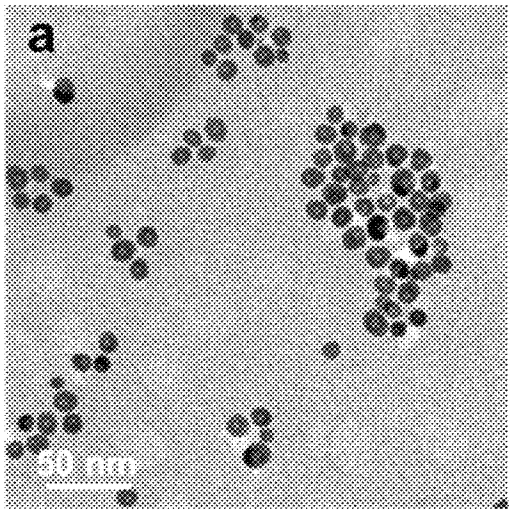
FIG. 6A
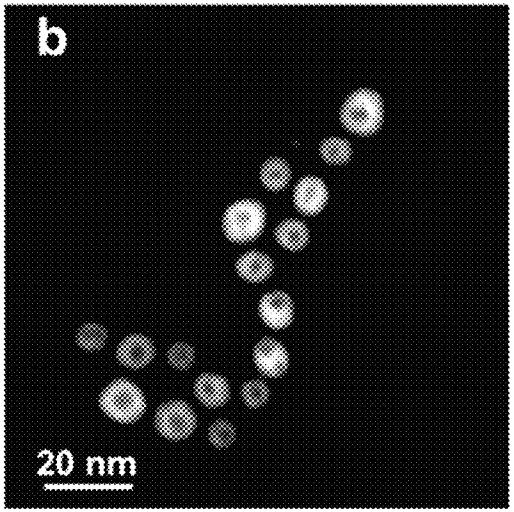
FIG. 6B
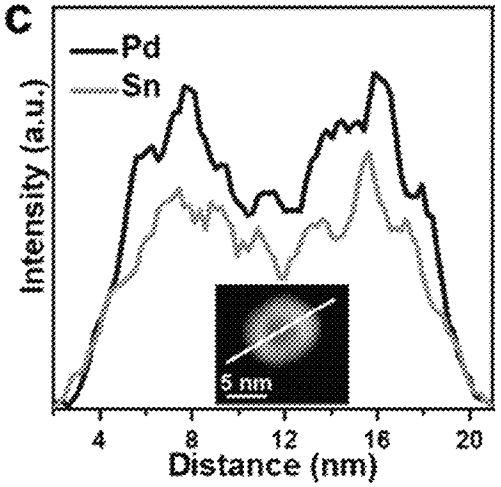
FIG. 6C
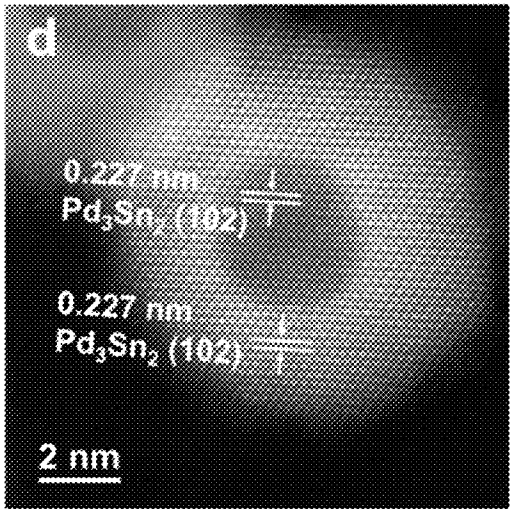
FIG. 6D
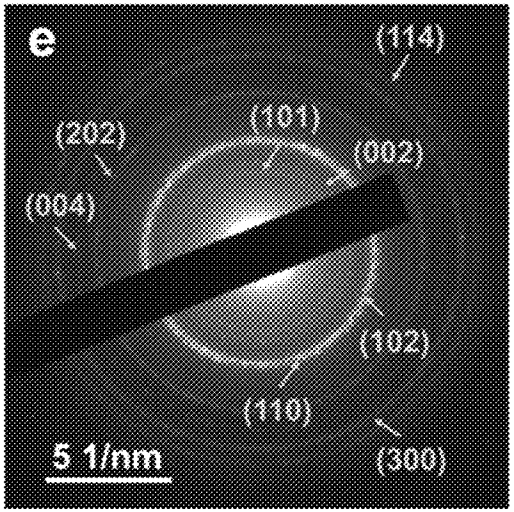
FIG. 6E
FIG. 6F

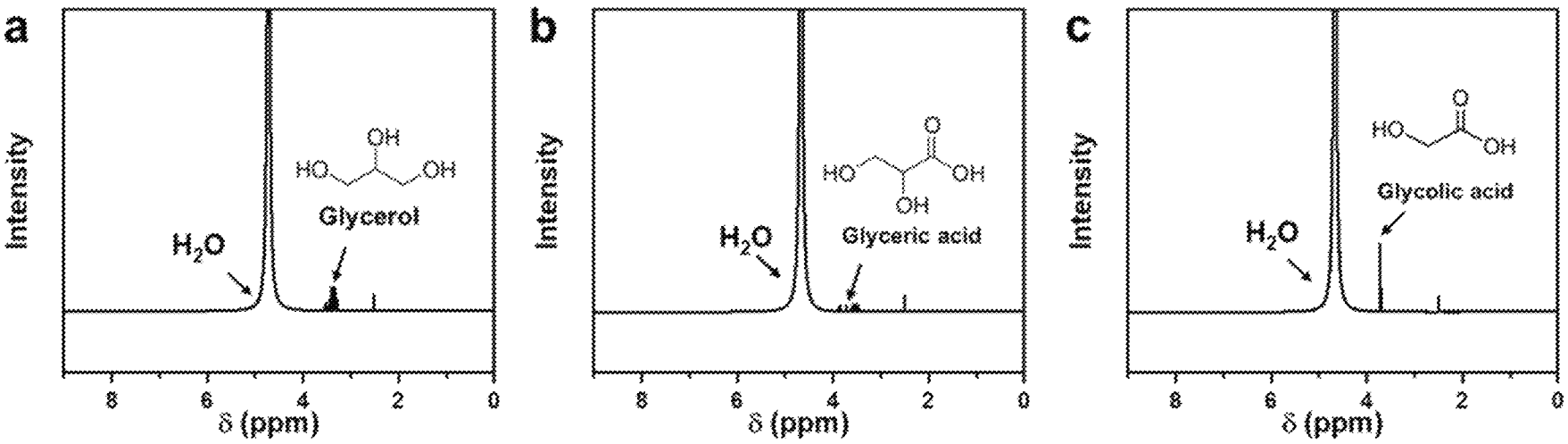
FIG.17A
FIG.17B
FIG.17C
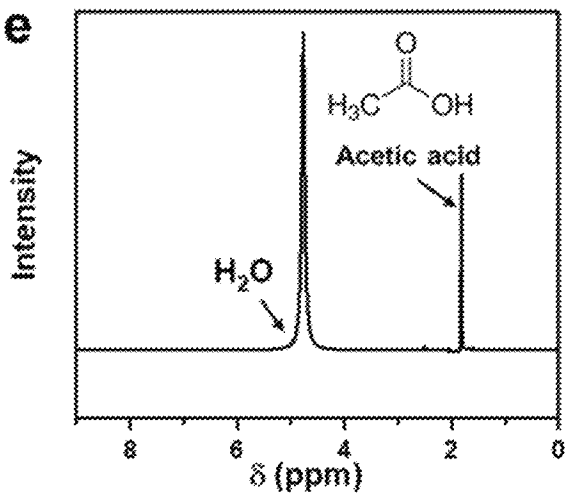
FIG.17D
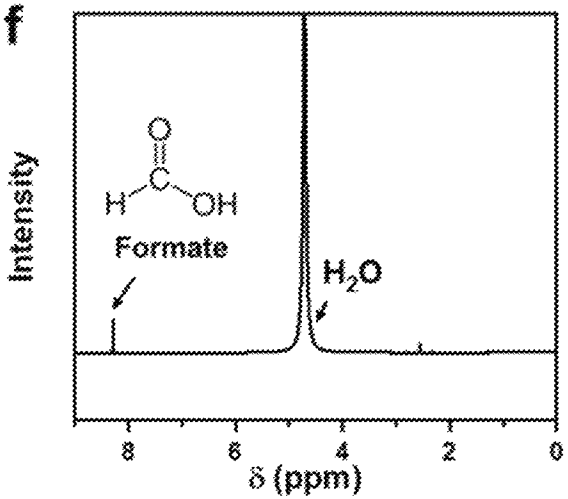
FIG.17E
FIG.17F

METHOD FOR SYNTHESIZING INTERMETALLIC ALLOY NANOPARTICLES

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to synthesis of intermetallic nanoparticles. More specifically the present invention relates to controllable synthesis of noble-metal based intermetallic nanoparticles with hollow or solid architectures.

BACKGROUND OF THE INVENTION

Noble metals have been intensively explored as promising candidates for versatile applications, especially in catalysis, owing to their unique physicochemical properties, while their practical application still suffers from the high cost and scarcity. Therefore, numerous research efforts have been devoted to developing high-performance catalysts with reduced content and increased utilization efficiency of noble metals. Specifically, alloying noble metals with high-abundance non-noble metals has been regarded as an appealing route, which not only reduces the usage of noble metals but also enhances their catalytic performances due to the synergistic effect of different metal atoms. Besides, the construction of hollow architectures in noble metal catalysts offers another promising approach to achieving this goal. Benefiting from the large specific surface area and open architecture, hollow noble metal catalysts could provide more exposed surface sites compared with their solid counterparts, thus enhancing the noble-metal utilization efficiency. To date, preparing noble metal-based alloys with hollow architectures has attracted extensive research attention for achieving high catalytic performance. However, the current studies are mainly limited to hollow noble metal-based alloys with conventional thermodynamically stable crystal phases.

Recently, phase engineering of nanomaterials (PEN) has been proven as a compelling strategy to modulate the intrinsic properties of noble metal-based nanomaterials and boost their catalytic performances by precisely tuning the atomic arrangements, which stimulates the synthesis of noble metal-based alloys with unconventional phases and allows the exploration of their phase-dependent properties and applications. In particular, noble metal-based intermetallic alloys with ordered atomic arrangements of component atoms represent a novel class of nanomaterials, exhibiting excellent performances towards various catalytic applications, e.g., carbon dioxide reduction reaction, oxygen reduction reaction, ethanol reduction reaction, and hydrogenation reaction. Although tremendous efforts have been devoted to the synthesis of noble metal-based intermetallic alloys with distinct crystal phases or architectures, most of the developed synthetic strategies can only yield intermetallic alloys with solid architectures and are not capable of tuning the crystal phase of products. The general and controlled preparation of hollow noble metal-based intermetallic alloys with different phases is highly desirable for the development of advanced catalysts and exploration of their structure-dependent performances.

SUMMARY OF THE INVENTION

In accordance with a first aspect of the present invention, a method for synthesizing intermetallic nanoparticles is provided. The method comprises: preparing noble-metal nanoparticle seeds; dispersing a metal precursor into the noble-metal nanoparticle seeds to form a first mixture; adding the first mixture into an organic solvent to form a first solution; sonicating the first solution at room temperature; subjecting the first solution to a heat treatment under $N_2$ atmosphere to render a second solution; cooling the second solution naturally to room temperature; adding ethanol to the second solution to form a third solution; and collecting the intermetallic nanoparticle from the third solution by centrifugation.

In accordance with one embodiment, a heating temperature of the heat treatment ranges from 200° C. to 300° C.; and a heating time of the heat treatment is longer than 1 hour.

In accordance with another embodiment, the heating temperature is 250° C.; and the heating time is 3 hours.

In accordance with another embodiment, the noble-metal nanoparticle seeds are made of noble-metal nanoparticles with hexagonal close-packed phase such that the synthesized intermetallic nanoparticles are hollow intermetallic nanoparticles.

In accordance with another embodiment, the noble-metal nanoparticles with hexagonal close-packed phase are Pd nanoparticles and the metal precursor is a Sn precursor such that the synthesized intermetallic nanoparticles are hollow Pd—Sn intermetallic nanoparticles.

In accordance with another embodiment, a weight ratio of the Sn precursor to the Pd nanoparticles ranges from 3:2 to 4:1 such that the synthesized Pd—Sn intermetallic nanoparticles are hollow orthorhombic $Pd_2Sn$ alloy nanoparticles.

In accordance with another embodiment, the weight ratio of the Sn precursor to the Pd nanoparticles is 12:7.

In accordance with another embodiment, the synthesized hollow orthorhombic $Pd_2Sn$ alloy nanoparticles have an average particle size of 10.2±1.8 nm and an average void size of 5.2=1.1 nm.

In accordance with another embodiment, a weight ratio of the Sn precursor to the Pd nanoparticles ranges from 7:1 to 10:1 such that the synthesized Pd—Sn intermetallic nanoparticles are hollow monoclinic $Pd_3Sn_2$ alloy nanoparticles.

In accordance with another embodiment, the weight ratio of the Sn precursor to the Pd nanoparticles is 60:7.

In accordance with another embodiment, the synthesized hollow monoclinic $Pd_3Sn_2$ alloy nanoparticles have an average particle size of 11.5±2.9 nm and an average void size of 5.5±2.9 nm.

In accordance with another embodiment, the noble-metal nanoparticle seeds are made of noble-metal nanoparticles with face-centred cubic phase such that the synthesized intermetallic nanoparticles are solid intermetallic nanoparticles.

In accordance with another embodiment, the noble-metal nanoparticles with face-centred cubic (fcc) phase are Pd nanoparticles and the metal precursor is a Sn precursor such that the synthesized intermetallic nanoparticles are solid Pd—Sn intermetallic nanoparticles.

In accordance with another embodiment, a weight ratio of the Sn precursor to the Pd nanoparticles ranges from 3:2 to 4:1 such that the synthesized Pd—Sn intermetallic nanoparticles are solid orthorhombic $Pd_2Sn$ alloy nanoparticles.

In accordance with another embodiment, the weight ratio of the Sn precursor to the Pd nanoparticles is 12:7.

In accordance with another embodiment, the synthesized solid orthorhombic $Pd_2Sn$ alloy nanoparticles have an average particle size of 7.4±0.7 nm.

In accordance with a second aspect of the present invention, a method of using intermetallic nanoparticles made by the afore-said synthesis method as catalysts for an electrochemical glycerol oxidation reaction is provided.

The present invention provides a controllable and general seeded method for synthesizing distinct intermetallic alloy nanoparticles with hollow or solid architectures. The as-synthesized hollow orthorhombic $Pd_2Sn$ (o-$Pd_2Sn$) alloy nanoparticles displays excellent glycerol oxidation reaction (GOR) performance with a high mass activity of 12.9 $A \cdot mg_{Pd}^{-1}$, which is 14.3 times that of commercial Pd/C and among the best of reported Pd-based GOR catalysts. The superior catalytic performance of hollow o-$Pd_2Sn$ compared to those of hollow monoclinic $Pd_3Sn_2$ (m-$Pd_3Sn_2$) and solid o-$Pd_2Sn$ counterparts demonstrates the importance of simultaneously regulating the crystal phase and architecture of nanomaterials in enhancing their catalytic performance. Operando infrared reflection absorption spectroscopy (IR-RAS) results suggest that hollow o-$Pd_2Sn$ could accelerate the cleavage of C—C bond when compared with commercial Pd/C. Such delicate control over both the phase and architecture of alloys could provide important guidance for the development of advanced nanomaterials for promising applications.

BRIEF DESCRIPTION OF THE DRAWINGS

Embodiments of the invention are described in more details hereinafter with reference to the drawings, in which:

FIGS. 6A and 6B illustrate TEM image and STEM image of hollow m-$Pd_3Sn_2$ NPs, respectively. FIG. 6C illustrates EDS elemental line scan along the white line in the STEM image (inset). FIG. 6D illustrates HAADF-STEM image of a representative hollow m-$Pd_3Sn_2$ NP. FIGS. 6E and 6F illustrate SAED pattern and XRD pattern (Inset of FIG. 6E: the corresponding model of crystal structures of m-$Pd_3Sn_2$) of hollow m-$Pd_3Sn_2$ NPs, respectively.

FIGS. 17A to 17F illustrate the 1H NMR reference spectra of glycerol, glyceric acid, glycolic acid, lactic acid, acetic acid, and formate. DMSO was added as an internal standard

DETAILED DESCRIPTION

Figure 1A:
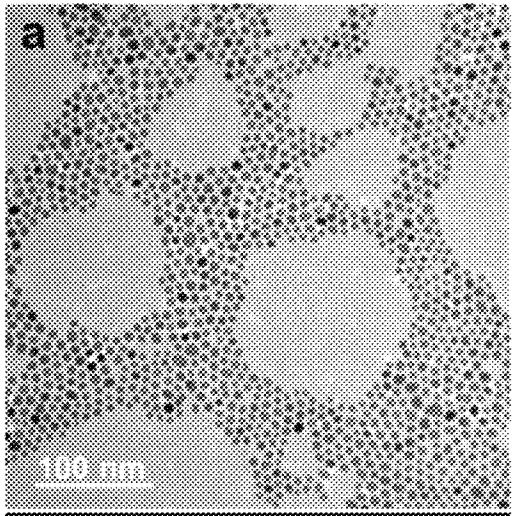
FIGS. 1A to 1D illustrate transmission electron microscopy (TEM) image, size distribution histogram, selected area electron diffraction (SAED) pattern and Pd 3d X-ray photoelectron spectroscopy (XPS) spectrum of Pd nanoparticles (NPs) with 2H phase.

In the following description, embodiments of the present invention are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

In one aspect of the present invention, a controlled and general method is provided for synthesizing distinct intermetallic alloy nanoparticles with hollow or solid architectures through wet-chemical reduction of a metal precursor and subsequent diffusion of the metal atoms into noble-metal nanoparticle NP seeds.

The controlled and general method comprises: preparing noble-metal nanoparticle NP seeds; dispersing a metal precursor into the noble-metal nanoparticle NP seeds to form a first mixture; adding the first mixture into an organic solvent (such as an amine, an alkene or a mixture thereof) to form a first solution; sonicating the first solution at room temperature; subjecting the first solution to a heat treatment under $N_2$ atmosphere to render a second solution; cooling the second solution naturally to room temperature; adding ethanol to the second solution to form a third solution; and collecting the hollow intermetallic nanomaterial from the third solution by centrifugation.

In some embodiments, hollow intermetallic alloy NPs may be synthesized by wet-chemical reduction of a metal precursor and subsequent diffusion of the metal atoms into seeds made of noble-metal NPs with 2H phase. For example, hollow PdSn intermetallic alloy NPs, such as orthorhombic $Pd_2Sn$ (o-$Pd_2Sn$) NPs or monoclinic $Pd_3Sn_2$ (m-$Pd_3Sn_2$) NPs may be synthesized by wet-chemical reduction of Sn precursor and subsequent diffusion of Sn atoms into seeds made of Pd NPs with 2H phase (2H—Pd NPs).

Synthesis of 2H—Pd NPs

2H—Pd nanoparticles may be prepared by heating the amorphous Pd (a-Pd) nanoparticles in an amine (e.g., oleylamine) in the absence of air. Typically, 1 mL of a-Pd nanoparticles in an organic solvent (e.g., toluene) was added to 12 mL of oleylamine in a 50 mL Schlenk tube under magnetic stirring. After stirring for 10 min at room temperature, the tube was evacuated for 10 min and then sealed to keep the high vacuum. Subsequently, the tube was placed into an oil bath at 180° C. and kept for 24 h, followed by natural cooling down to room temperature. After adding 20 mL of ethanol, the product was collected by centrifugation at 12,000 rpm for 10 min.

After the as-obtained 2H—Pd nanoparticles were dispersed into 5 mL of toluene and sonicated, 20 mL of ethanol were added to precipitate them. The 2H—Pd nanoparticles were then collected by centrifugation at 12,000 rpm for 10 min. The aforementioned washing process was repeated for twice.

The 2H—Pd nanoparticles were then re-dispersed in 1 mL of toluene. Subsequently, the aforementioned 2H—Pd nanoparticles were heated in oleylamine in air to remove the excess S-containing ligands capped on the surface. Typically, 1 mL of aforementioned 2H—Pd nanoparticles in toluene was added to 6 mL of oleylamine in a 20 mL vial under magnetic stirring. After stirring for 10 min at room temperature, the vial was placed into an oil bath at 130° C. and then kept for 6 h, followed by natural cooling down to room temperature. The final product was collected by centrifugation at 12,000 rpm for 10 min after adding 30 mL of ethanol.

After the 2H—Pd nanoparticles were dispersed into 5 mL of toluene and sonicated, 20 mL of ethanol were added to precipitate them. The washed 2H—Pd nanoparticles were then collected by centrifugation at 12,000 rpm for 10 min. Preferably, the aforementioned washing process was repeated for twice.

Characterization of 2H—Pd NPs

Figure 1B:
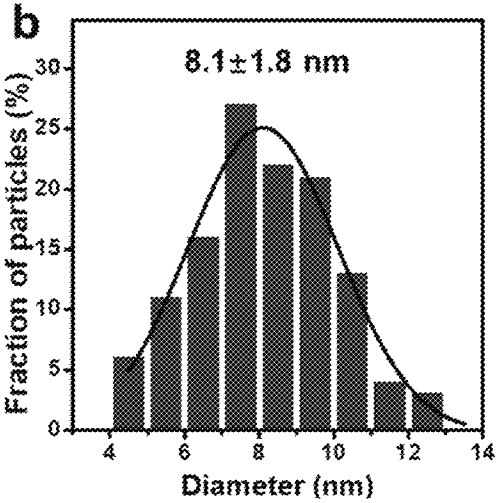
Figure 1C:
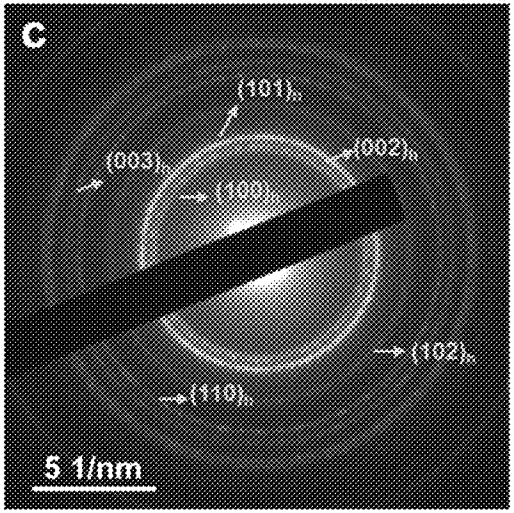
Figure 1D:
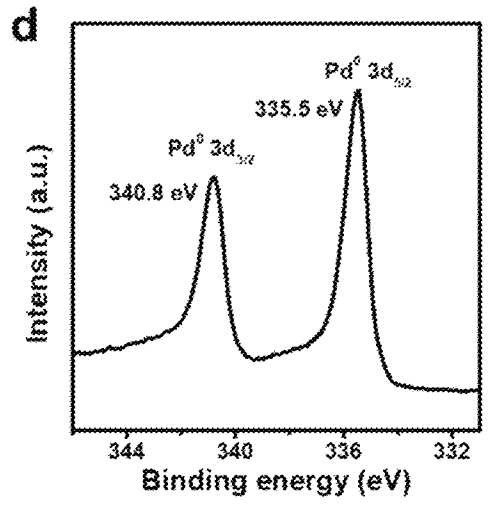

The TEM observation (FIG. 1A) shows the solid architecture of the as-synthesized 2H—Pd NPs with an average particle size of 8.1±1.8 nm (FIG. 1B). The 2H phase can be confirmed by the SAED pattern in FIG. 1C. XPS result confirms the metallic state of Pd element in 2H—Pd, in which the two peaks assigned to $Pd^0$ $3d_{5/2}$ and $Pd^0$ $3d_{3/2}$ locate at 335.5 and 340.8 eV, respectively (FIG. 1D).

Synthesis of Hollow o-$Pd_2Sn$ NPs

In a typical synthesis of hollow o-$Pd_2Sn$ NPs, 70 μg of the 2H—Pd NPs (determined by the ICP-OES) and 120 μg of $SnCl_2$ were dispersed into 2 mL of oleylamine in a 50 mL Schlenk tube and sonicated at room temperature to ensure the complete dissolution. Subsequently, the Schlenk tube was evacuated for 20 min at room temperature and purged with $N_2$ flow. After being sealed tightly, the Schlenk tube was heated by a metal bath at 250° C. under magnetic stirring for 3 hours, followed by natural cooling down to room temperature. The produced hollow o-$Pd_2Sn$ NPs was collected by centrifugation at 10,000 rpm for 2 min after adding 2 mL of ethanol. Then the as-obtained hollow o-$Pd_2Sn$ NPs were re-dispersed into 2 mL of organic solvent (e.g., toluene) and sonicated for 1 min, followed by adding 2 mL of ethanol to precipitate them. The hollow o-$Pd_2Sn$ NPs was then collected by centrifugation at 10,000 rpm for 2 min. The aforementioned washing process was repeated twice. The washed hollow o-$Pd_2Sn$ NPs were finally re-dispersed in toluene.

Characterization of Hollow o-$Pd_2Sn$ NPs

Figure 2A:
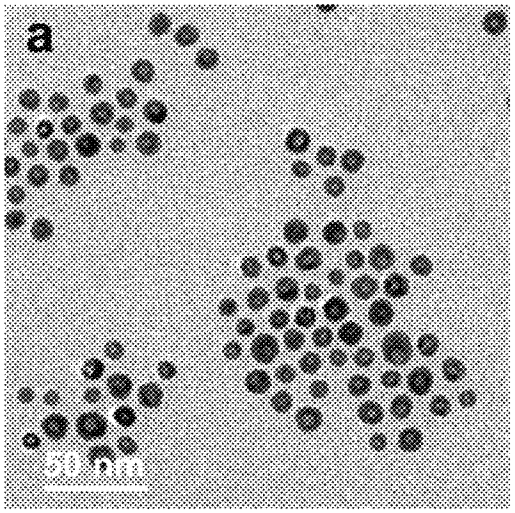
FIGS. 2A and 2B illustrate TEM image and scanning TEM (STEM) images of hollow o-$Pd_2Sn$ NPs respectively.
Figure 2B:
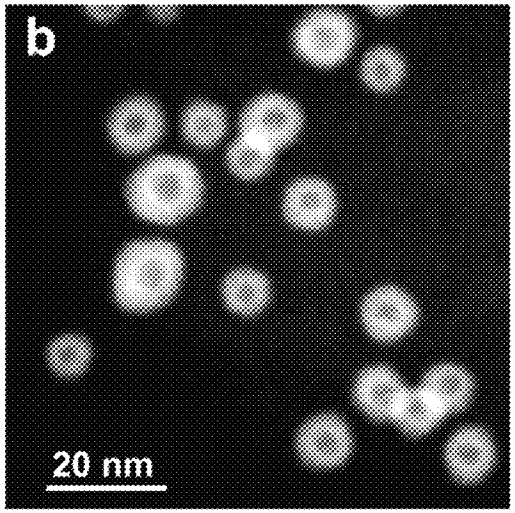
Figure 3C:
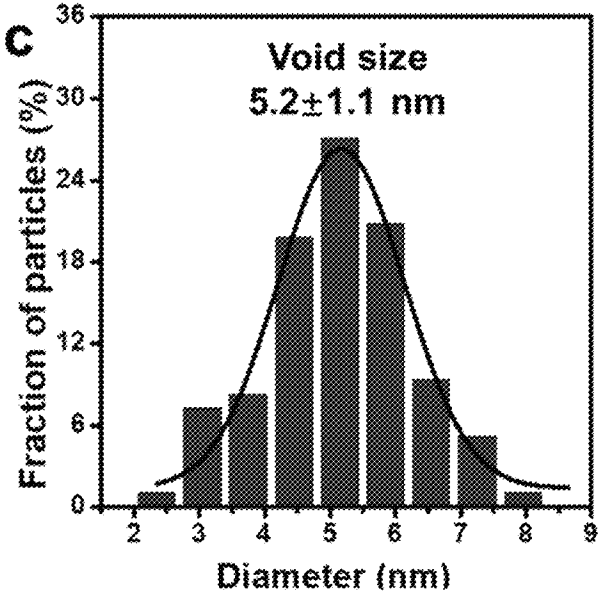
FIGS. 3B and 3C are particle size and void size distribution histograms of hollow o-$Pd_2Sn$ NPs, respectively.
Figure 3B:
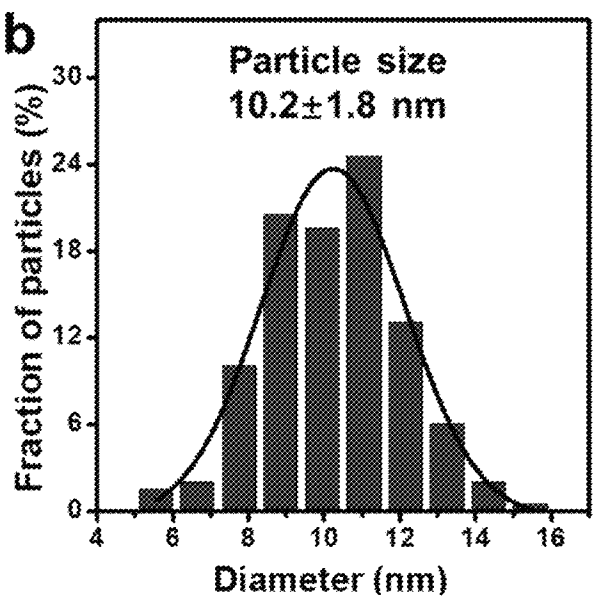
Figure 3A:
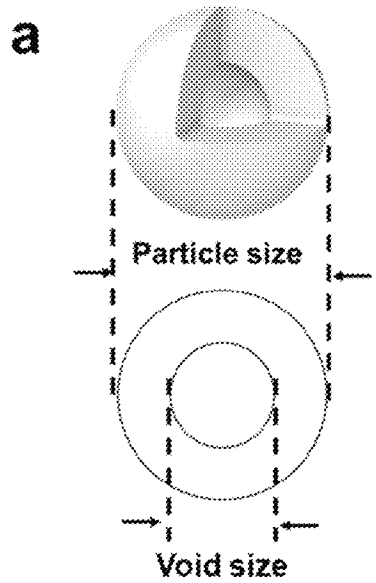
FIG. 3A is schematic illustration of the particle size and void size of a typical hollow NP.

The hollow architecture of the synthesized o-$Pd_2Sn$ NPs can be confirmed by TEM (FIG. 2A) and STEM images (FIG. 2B). The average particle size and void size of hollow o-$Pd_2Sn$ NPs are 10.2±1.8 nm and 5.2±1.1 nm, respectively (FIGS. 3A-3C). The particle size of as-obtained hollow o-$Pd_2Sn$ is larger than that of the 2H—Pd seeds (8.1±1.8 nm).

Figure 2C:
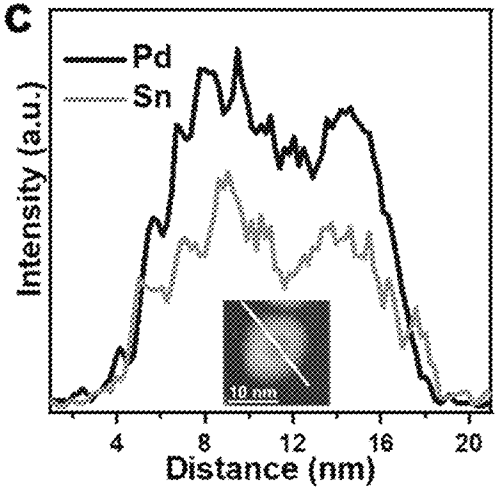
FIG. 2C illustrates energy dispersive X-ray spectroscopy (EDS) elemental line scan along the white line in a STEM image of a representative hollow o-$Pd_2Sn$ NP (inset).
Figure 4B:
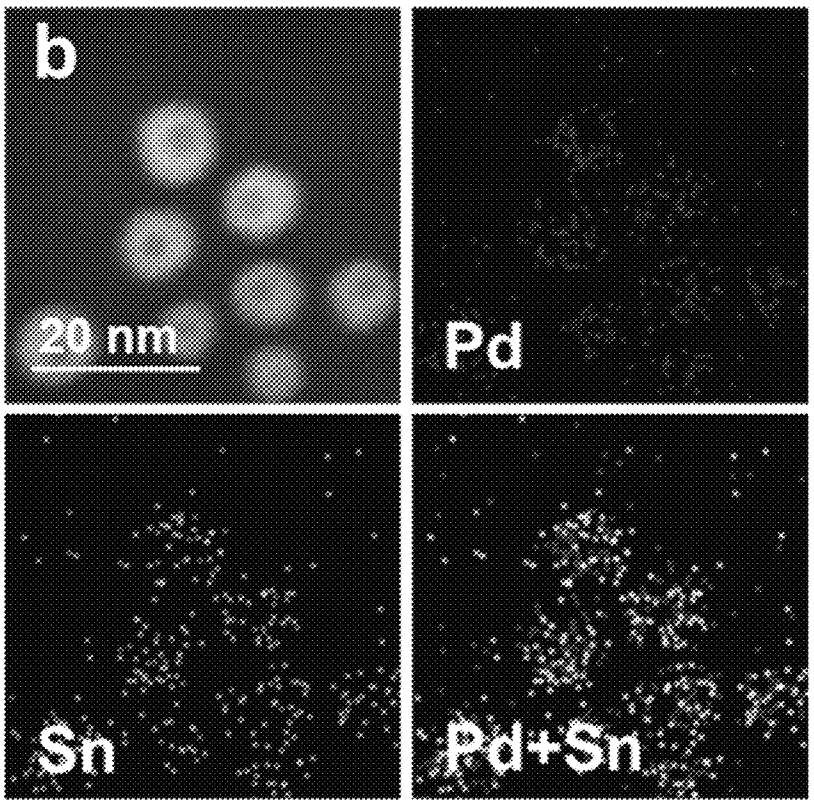
FIG. 4B illustrates STEM image and the corresponding EDS elemental mappings of hollow o-$Pd_2Sn$ NPs.
Figure 4A:
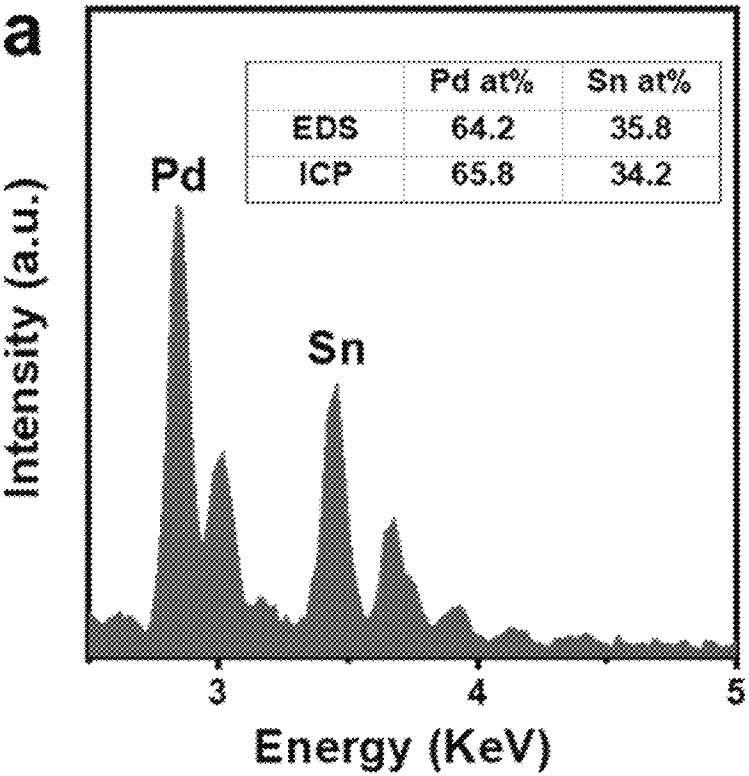
FIG. 4A illustrates EDS and inductively coupled plasma optical emission spectrometry (ICP-OES) characterizations of hollow o-$Pd_2Sn$ NPs. The additional element signals arise from the TEM grid. Inset: comparison of Pd and Sn contents based on the EDS and ICP-OES results.

The atomic ratio of Pd/Sn in the hollow o-$Pd_2Sn$ NPs is about 64/36 as determined by EDS spectrum and ICP-OES result (FIG. 4A). The comparison of Pd and Sn contents based on the EDS and ICP-OES results (inset of FIG. 4A) show a good agreement. The EDS mapping result (FIG. 4B) reveals the uniform distribution of Pd and Sn elements in the hollow o-$Pd_2Sn$ NPs, indicating the formation of alloy structure. Moreover, EDS line scan of a typical hollow o-$Pd_2Sn$ NP exhibits weaker signals of both Pd and Sn elements in the void part (FIG. 2C), further confirming the formation of hollow architecture.

Figure 2D:
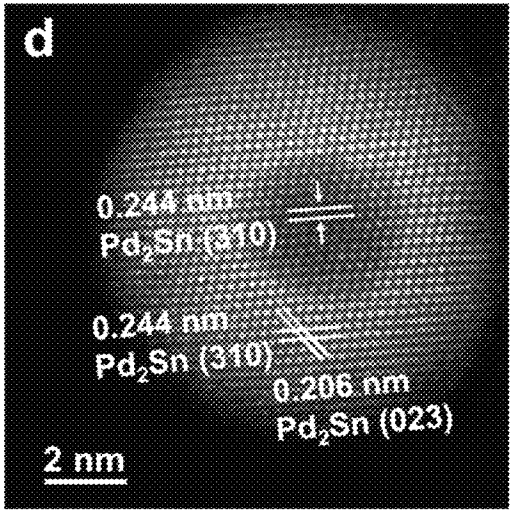
FIG. 2D illustrates high-angle annular dark-field STEM (HAADF-STEM) image of a representative hollow o-$Pd_2Sn$ NP.
Figure 2E:
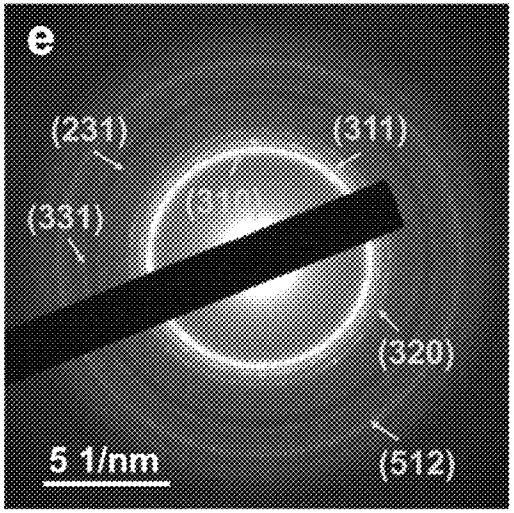
FIGS. 2E and 2F illustrate SAED pattern and X-ray diffraction (XRD) pattern of hollow o-$Pd_2Sn$ NPs respectively.
Figure 2F:
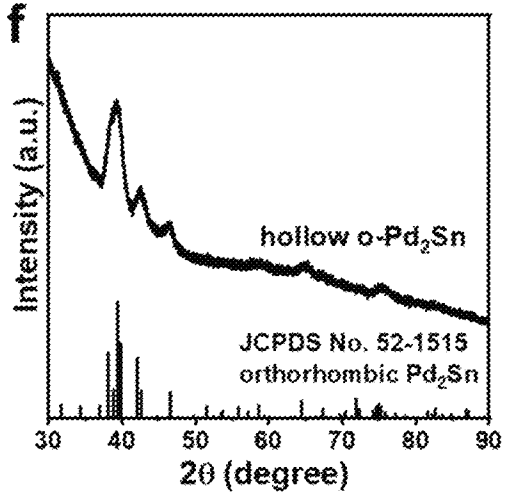

The HAADF-STEM image of a representative hollow o-$Pd_2Sn$ NP (FIG. 2D) shows clear lattice fringes with spacings of 0.244 and 0.206 nm, which correspond to (310) and (023) planes of o-$Pd_2Sn$ intermetallic phase, respectively. The diffraction rings in the SAED pattern (FIG. 2E) and the diffraction peaks in the X-ray diffraction (XRD) pattern (FIG. 2F) can be well indexed to the orthorhombic phase, further corroborating the formation of o-$Pd_2Sn$ intermetallic alloy with high phase purity.

Figure 5B:
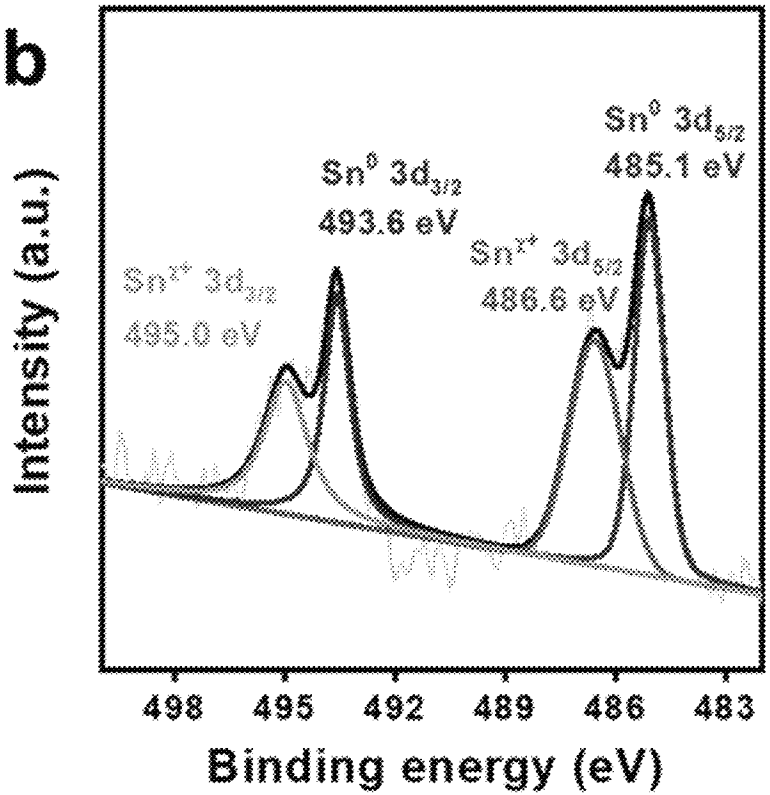
FIGS. 5A and 5B illustrate Pd 3d and Sn 3d XPS spectra of hollow o-$Pd_2Sn$ NPs, respectively.
Figure 5A:
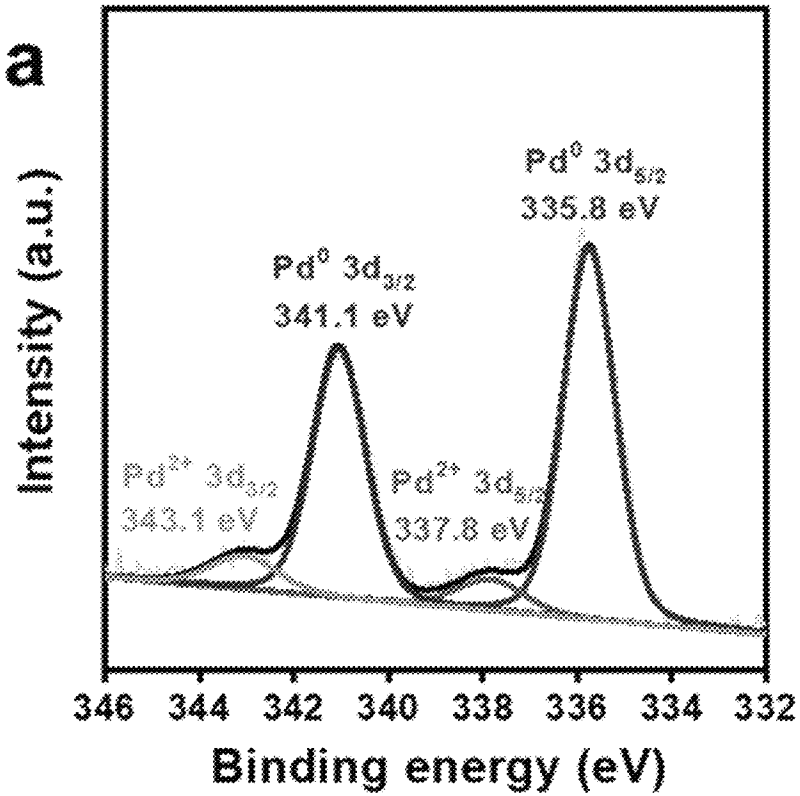

In addition, XPS spectra were measured to study the valence states of Pd and Sn in hollow o-$Pd_2Sn$ NPs. The Pd 3d spectrum suggests the predominant metallic state of Pd element since the ratio of $Pd^0$ is much higher than that of $Pd_{2+}$ (FIG. 5A). It is also worth mentioning that the $Pd^0$ 3d peaks at 335.8 and 341.1 eV in hollow o-$Pd_2Sn$ NPs shift positively compared to those in 2H—Pd seeds (335.5 and 340.8 eV), indicating the change of electronic structure of Pd due to the alloying with Sn. Moreover, the Sn 3d spectrum demonstrates the mixed valence states of Sn element in hollow o-$Pd_2Sn$ NPs with the co-existence of $Sn^0$ and $Sn^{x+}$ ($Sn^{2+}$ and/or $Sn^{4+}$) (FIG. 5B).

Synthesis of Hollow m-$Pd_3Sn_2$ NPs

Typically, hollow m-$Pd_3Sn_2$ NPs may be synthesized by following the aforementioned method for the typical synthesis of hollow o-$Pd_2Sn$ NPs except for except for increasing the amount of $SnCl_2$ from 120 μg to 600 μg.

Characterization of Hollow m-$Pd_3Sn_2$ NPs

Figure 7A:
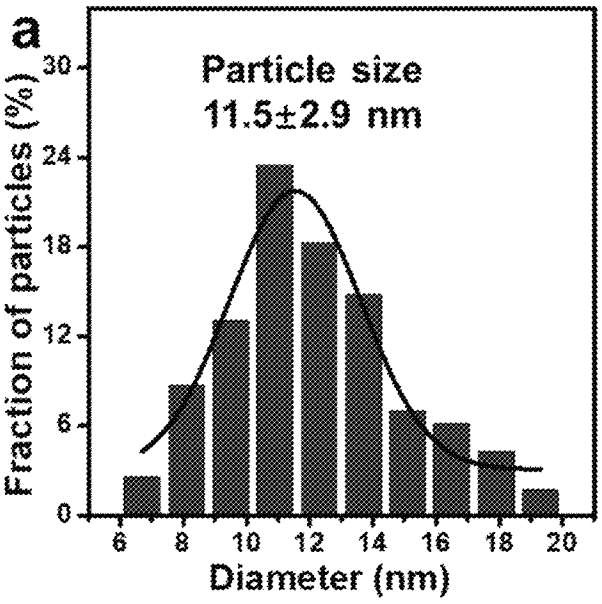
FIGS. 7A and 7B illustrate particle size and void size distribution histograms of hollow m-$Pd_3Sn_2$ NPs, respectively.
Figure 7B:
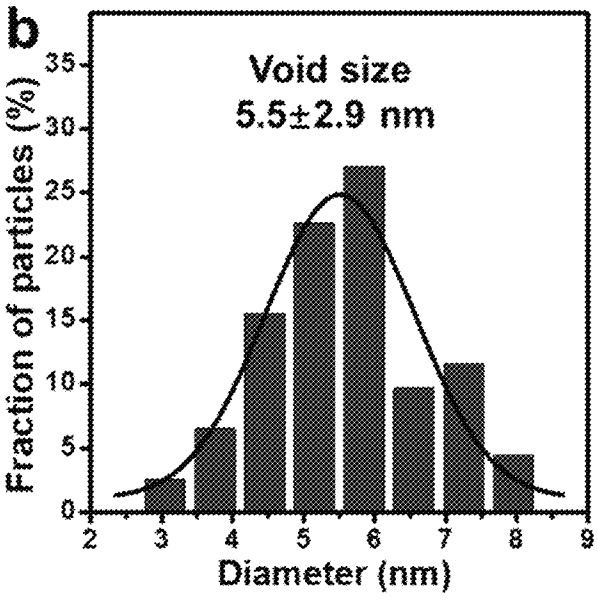

TEM (FIG. 6A) and STEM (FIG. 6B) images reveal the high uniformity and good dispersion of the obtained hollow m-$Pd_3Sn_2$ NPs with mean particle size and void size of 11.5±2.9 nm and 5.5±2.9 nm, respectively (FIGS. 7A-7B).

The hollow architecture of m-$Pd_3Sn_2$ NPs can be further verified by the obvious decrease of Pd and Sn signals in the middle part of EDS line scan profiles (FIG. 6C).

Figure 8B:
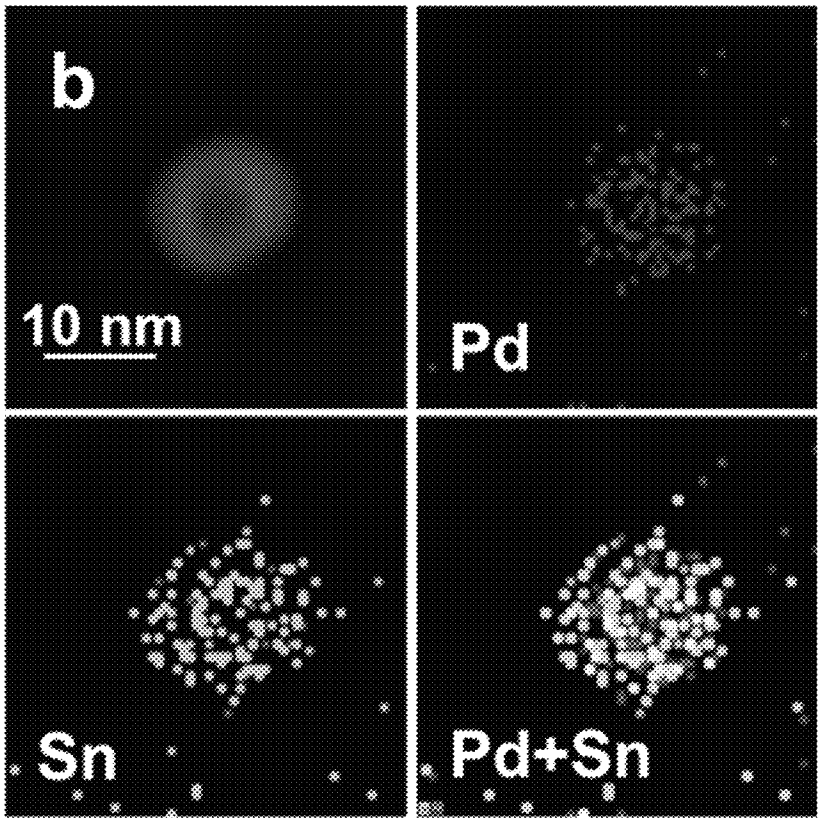
FIG. 8B illustrates STEM image and the corresponding EDS elemental mappings of hollow m-$Pd_3Sn_2$ NPs.
Figure 8A:
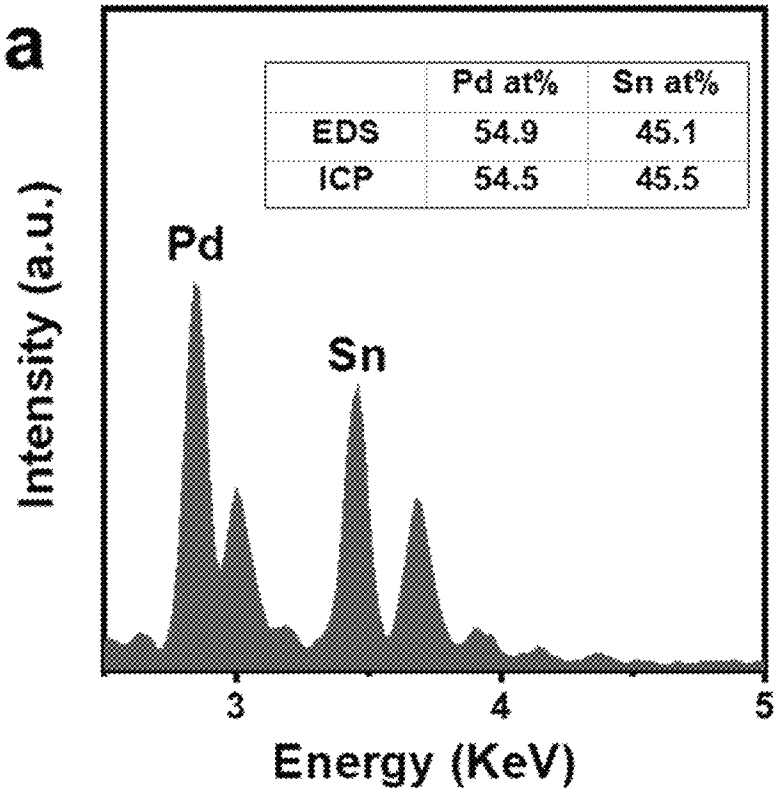
FIG. 8A illustrates EDS and ICP-OES characterizations of hollow m-$Pd_3Sn_2$ NPs. The additional element signals arise from the TEM grid. Inset: comparison of Pd and Sn contents based on the EDS and ICP-OES results.

The Pd/Sn atomic ratio determined from the EDS spectrum is about 55/45, which is consistent with the ICP-OES result (FIG. 8A), and the alloying of Pd and Sn could be further confirmed by the EDS mapping results (FIG. 8B). The comparison of Pd and Sn contents based on the EDS and ICP-OES results (inset of FIG. 8A) show a good agreement.

HADDF-STEM image (FIG. 6D) shows clear lattice fringes with spacings of 0.227 nm in both the inner and outer parts, corresponding to the (102) plane of m-$Pd_3Sn_2$ phase. Besides, the diffraction rings in SAED pattern are well assigned to m-$Pd_3Sn_2$ phase (FIG. 6E), indicating the high phase purity, which is further affirmed by the XRD pattern (FIG. 6F).

Figure 9B:
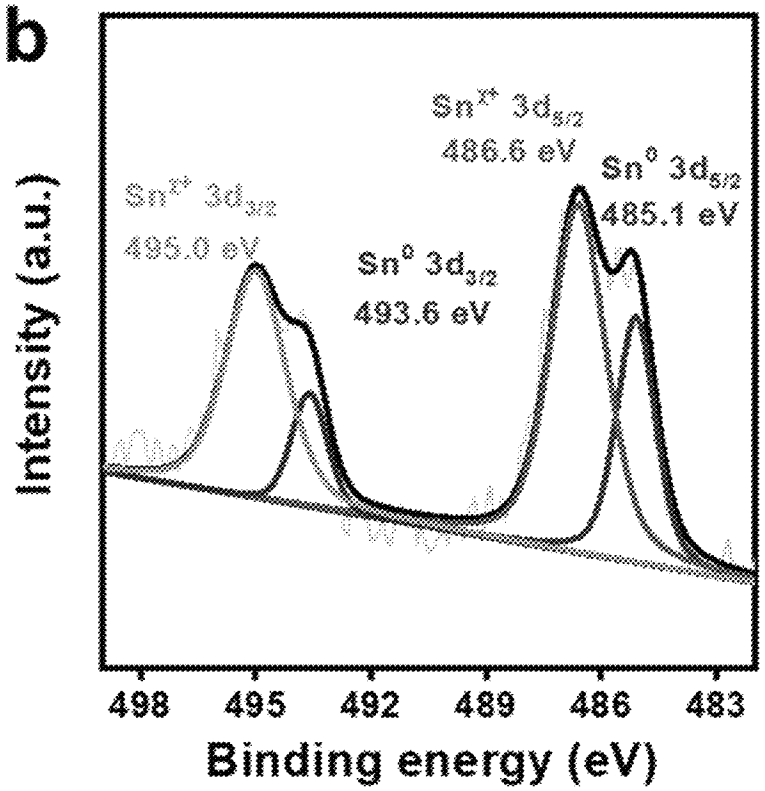
FIGS. 9A and 9B illustrate Pd 3d and Sn 3d XPS spectra of hollow m-$Pd_3Sn_2$ NPs, respectively.
Figure 9A:
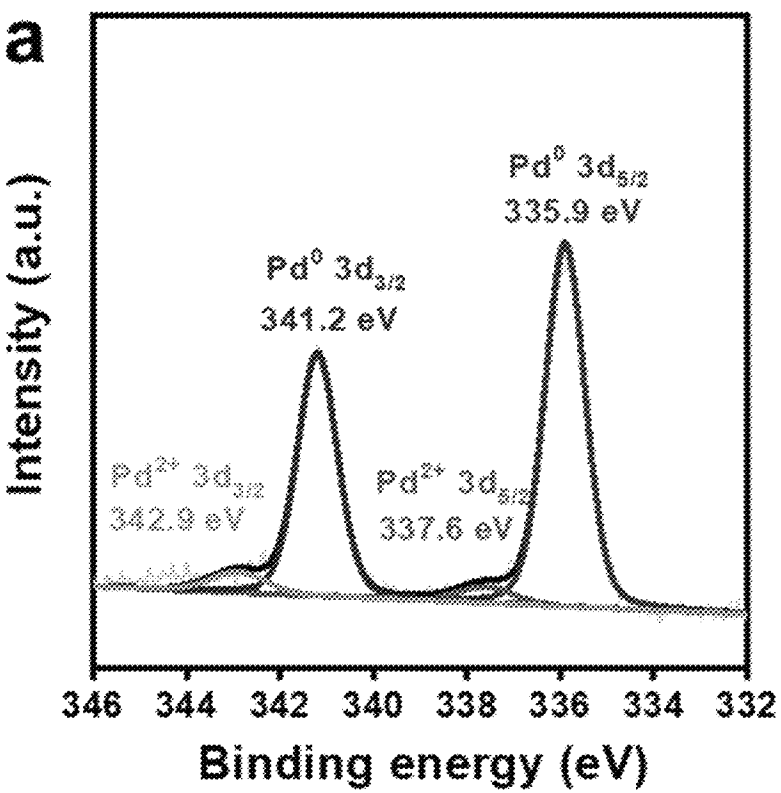

The valance states of Pd and Sn in hollow m-$Pd_3Sn_2$ NPs were also studied by XPS characterization. As revealed by the Pd 3d spectrum (FIG. 9A), Pd element is mainly in its metallic state. Similar to the XPS results of hollow o-$Pd_2Sn$ NPs, the binding energies of $Pd^0$ 3d peaks (335.9 and 341.2 eV) show a positive shift compared to those of 2H—Pd seeds (335.5 and 340.8 eV), and the Sn 3d spectrum (FIG. 9B) can be fit into two doublets that correspond to the metallic state and oxidated states of Sn, respectively.

In some other embodiments, solid intermetallic alloy may be synthesized by the wet-chemical reduction of a metal precursor and subsequent diffusion of the metal atoms into seeds made of noble-metal NPs with fcc phase. For example, solid PdSn intermetallic alloy NPs, such as, solid o-$Pd_2Sn$ NPs, may be synthesized by wet-chemical reduction of Sn precursor and subsequent diffusion of Sn atoms into seeds made of Pd NPs with fcc phase (fcc-Pd NPs).

Synthesis of fcc-Pd NPs

In a typical synthesis of the fcc-Pd NPs, 0.25 mmol of palladium (II) acetylacetonate were dissolved in 15 mL of an amine (e.g., oleylamine) and subsequently heated to 60° C. under nitrogen gas flow and magnetic stirring. Then, 3 mL of oleylamine containing 0.2 g of borane morpholine complex were injected into the aforementioned solution. The temperature was slowly increased to 90° C. and kept for 30 min before cooling to room temperature. The fcc-Pd NPs were collected by centrifugation at 10,000 rpm for 10 min after adding 30 mL of ethanol. Preferably, the synthesized fcc-Pd NPs was washed twice with mixed solution of organic solvents (e.g., toluene and ethanol (v:v=1:6)) and finally dispersed in toluene.

Characterization of fcc-Pd NPs

Figure 10A:
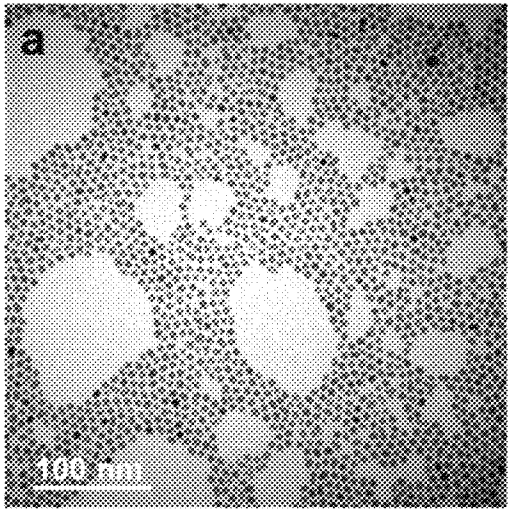
FIGS. 10A to 10D illustrate TEM image, size distribution histogram, SAED pattern and Pd 3d XPS spectrum of fcc-Pd NPs, respectively.
Figure 10B:
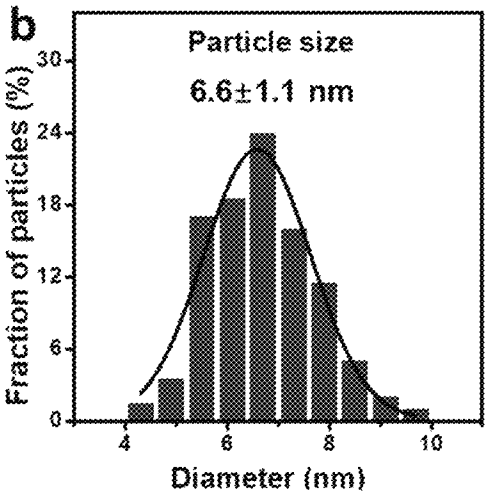
Figure 10C:
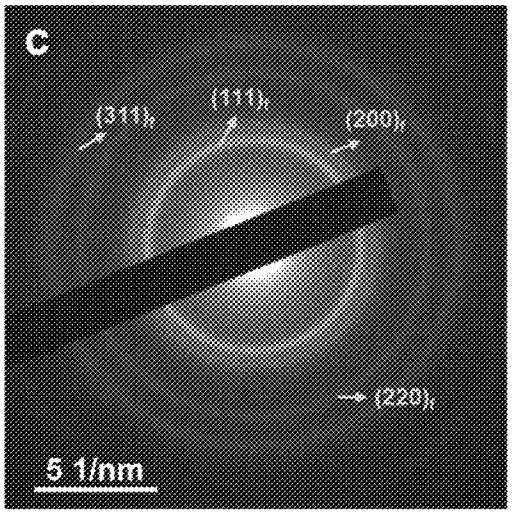
Figure 10D:
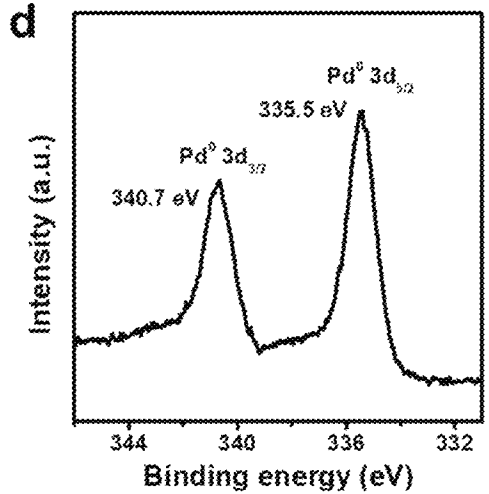

TEM image (FIG. 10A) shows the as-synthesized fcc-Pd NPs have average size of about 6.6±1.1 nm (FIG. 10B), which is close to that of 2H—Pd NPs. SAED pattern (FIG. 10C) indicates the formation of pure fcc phase. XPS result suggests that Pd element in fcc-Pd NPs is mainly in metallic state (FIG. 10D).

Synthesis of Solid o-$Pd_2Sn$ NPs

Typically, solid o-$Pd_2Sn$ NPs may be synthesized by following the aforementioned method for the typical synthesis of hollow o-$Pd_2Sn$ NPs except for replacing the seeds made of 70 μg of 2H—Pd NPs to seeds made of 70 μg of fcc-Pd NPs.

Characterization of Solid o-$Pd_2Sn$ NPs

Figure 11A:
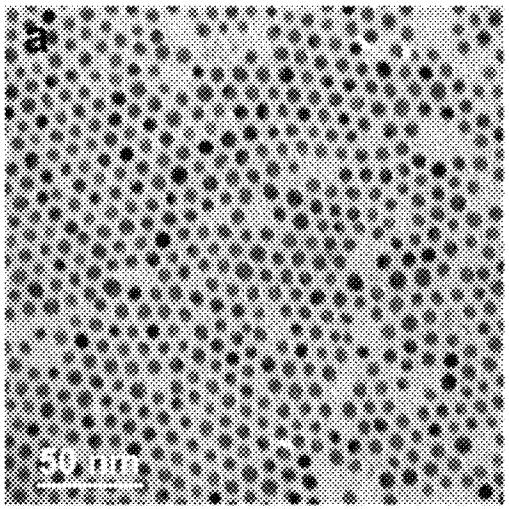
FIGS. 11A and 11B illustrate TEM image and size distribution histogram of solid o-$Pd_2Sn$ NPs, respectively.
Figure 11B:
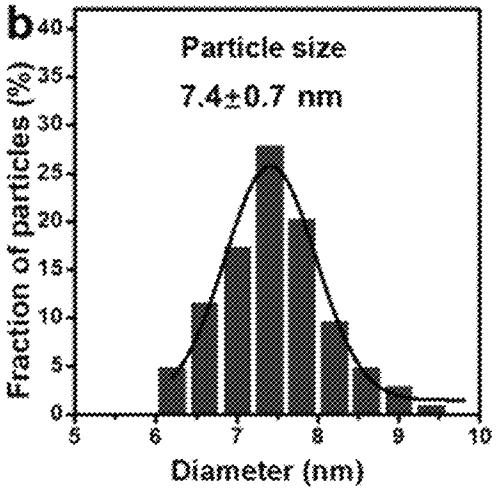
Figure 11C:
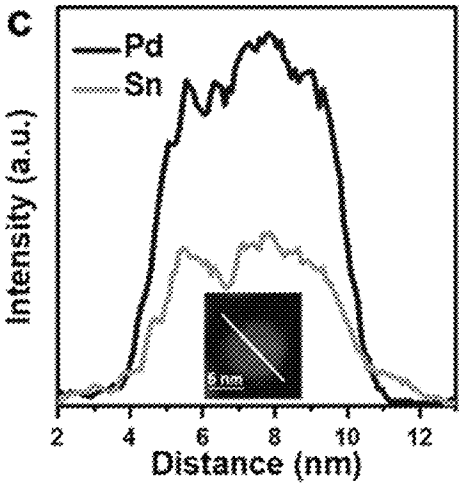
FIG. 11C illustrates EDS elemental line scan along the white line in the STEM image (inset) of a solid o-$Pd_2Sn$ NP.
Figure 11D:
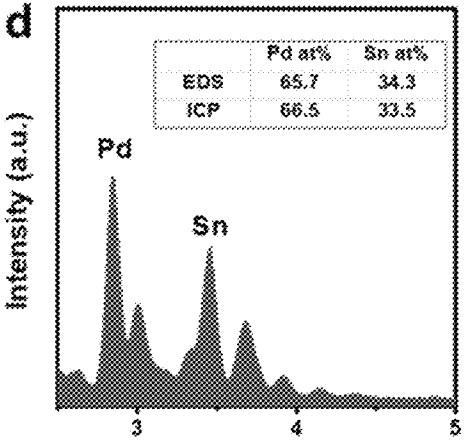
FIG. 11D illustrates EDS and ICP-OES characterizations of solid o-$Pd_2Sn$ NPs. The additional element signals arise from the TEM grid. Inset: comparison of Pd and Sn contents based on the EDS and ICP-OES results.
Figure 11E:
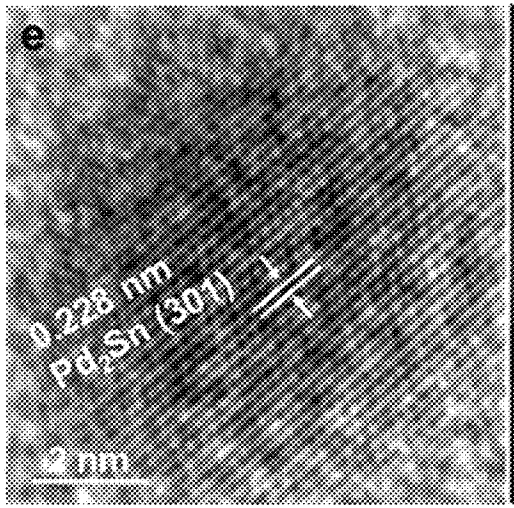
FIGS. 11E and 11F illustrate high-resolution TEM (HRTEM) image and SAED pattern of solid o-$Pd_2Sn$ NPs, respectively.
Figure 11F:
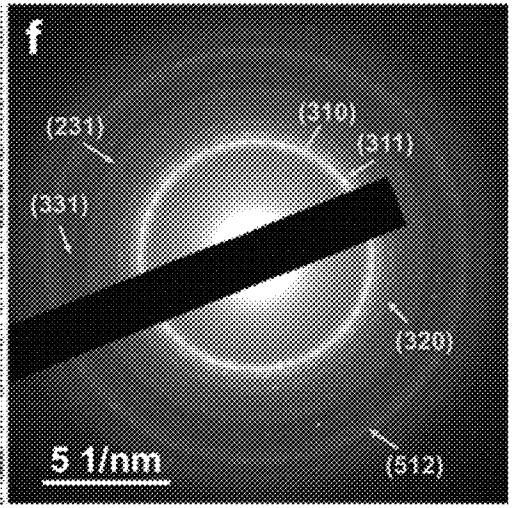

The solid o-$Pd_2Sn$ NPs synthesized by using fcc-Pd NPs as seeds possess a sphere-like shape without the formation of voids (FIG. 11A) and an average size of 7.4±0.7 nm (FIG. 11B), which is slightly larger than that of the fcc-Pd seeds. EDS line scan of an individual solid o-$Pd_2Sn$ NP suggests the homogenous distribution of Pd and Sn elements throughout the NP (FIG. 11C), further indicating the formation of solid architecture. As shown in FIG. 11D, the atomic ratio between Pd and Sn is determined as about 2/1 based on both the EDS spectrum and ICP-OES measurements. The comparison of Pd and Sn contents based on the EDS and ICP-OES results (inset of FIG. 11D) show a good agreement. In the HRTEM image (FIG. 11E), the measured lattice spacing of 0.228 nm can be indexed to the (301) plane of o-$Pd_2Sn$ phase. The diffraction rings in the SAED pattern further corroborate the high phase purity of solid o-$Pd_2Sn$ NPs (FIG. 11F).

It should be appreciated that the provided method can be used to other types of Pd-based intermetallic alloy nanoparticles with hollow or solid architectures, including, but not limited to, binary or ternary intermetallic Pd-based nanoparticles. More particularly, the intermetallic Pd-based nanoparticles may be any one of Pd—Bi, Pd—Pb, Pd—Cd, Pd—Zn, Pd—Cu, Pd—Sn—Cu, or Pd—Sn—Co nanoparticles.

In another aspect of the present invention, the as-prepared PdSn intermetallic alloys, including hollow o-$Pd_2Sn$, solid o-$Pd_2Sn$, and hollow m-$Pd_3Sn_2$, may be applied respectively as catalysts toward the electrochemical GOR in alkaline media.

Preparation of Catalyst Inks

Typically, 10 mg of Vulcan XC-72R carbon black were first dispersed in 10 mL of ethanol and sonicated in an ice bath for 1 h to obtain a homogeneous solution. Subsequently, a catalyst solution containing 150 μg of one of the abovementioned as-prepared PdSn intermetallic alloy, determined by ICP-OES, was dropwise added into 1.35 mL of as-obtained carbon solution in a 4 mL glass vial, followed by sonication for another 1 h in an ice bath. Subsequently, the obtained catalyst on carbon (catalyst/C, 10 wt %) was collected by centrifugation at 14,800 rpm for 5 min, followed by washing five times with a mixed solvent of chloroform and ethanol (v:v=1:1). The obtained catalyst/C was finally dispersed in 1 mL of the mixture of Milli-Q water and isopropanol (v:v=3:7), and the concentration of Pd in catalyst/C was further determined by ICP-OES. Then, 100

μL of Nafion alcohol solution (5 wt %) were added in the catalyst/C solution, followed by sonication for another 30 min.

Catalytic Performance Towards Electrochemical GOR

All electrochemical measurements were carried out in a standard three-electrode cell system using an electrochemical workstation (CHI 760E, CH Instrument, Inc.) at room temperature (~25° C.). Glassy carbon electrode (GCE, 5 mm) coated with the prepared catalyst was used as the working electrode. Pt wire and Hg/HgO electrode were used as counter and reference electrodes, respectively. All potentials were converted into the values in reference to RHE, by using this formula: F(RHE)=F(Hg/HgO)+0.097+0.059×pH. Before each test, GCE was sequentially polished by $Al_2O_3$ slurry with particle sizes of 300 and 50 nm, followed by washing with Milli-Q water and ethanol to ensure a clean surface. Subsequently, the catalyst ink with 3 μg of catalysts/C was dropped onto the GCE surface and dried under ambient conditions. CV measurements of the working electrodes in $N_2$-saturated aqueous solution containing 1.0 M KOH were first carried out in a potential range from 0.1 to 1.3 V (vs. RHE) at a scan rate of 50 m $V \cdot s^{-1}$ for 50 cycles to remove the ligands on catalyst surfaces and get stable CV curves. The ECSAs were calculated based on the charge required for oxygen desorption, that is, from the area of the reduction peak of PdO in the as-obtained CV curves.

The ECSA values (in terms of $m^2 \cdot g_{Pd}^{-1}$) of the catalysts were estimated based on the equation, $ECSA=Q/(0.405 \times m_{Pd})$, where Q is the coulombic charge by integrating peak areas of the reduction of PdO (mC), $m_{Pd}$ is the Pd loading ($mg \cdot cm^{-2}$), and the constant (0.405) represents the charge required for the reduction of PdO monolayer ($mC \cdot cm^{-2}_{Pd}$).

Then, the activity of the catalysts towards GOR was evaluated by CV measurements in a mixed $N_2$-saturated solution containing 1.0 M KOH and 1.0 M glycerol between 0.1 and 1.3 V (vs. RHE) at 50 $mV \cdot s^{-1}$. Current transients were carried out by stepping the potential from 0.5 to 0.9 V (vs. RHE) and holding the potential for 30 s. The Tafel slopes of these catalysts were carried out in the mixed solution containing 1.0 M KOH and 1.0 M glycerol at a scan rate of 50 $mV \cdot s^{-1}$. The stability of the catalysts was evaluated by chronoamperometric measurements at 0.9 V (vs. RHE) for 3,600 s in the mixed solution containing 1.0 M KOH and 1.0 M glycerol.

Figure 12A:
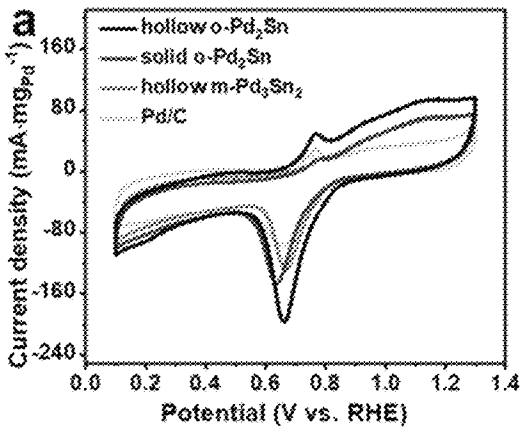
FIG. 12A illustrates cyclic voltammogram (CV) curves of hollow o-$Pd_2Sn$, solid o-$Pd_2Sn$, hollow m-$Pd_3Sn_2$, and commercial Pd/C, recorded in $N_2$-saturated 1.0 M KOH aqueous solution at a scan rate of 50 $mV \cdot s^{-1}$.
Figure 12B:
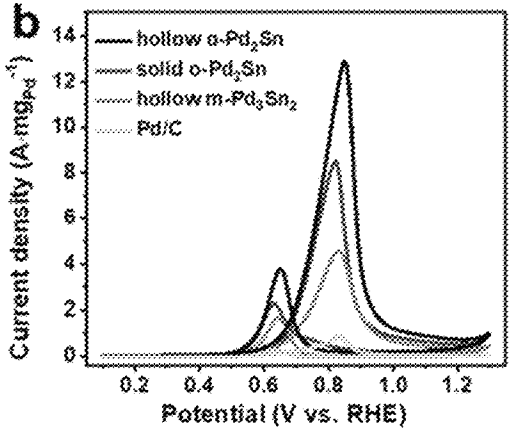
FIG. 12B illustrates CV curves of hollow o-$Pd_2Sn$, solid o-$Pd_2Sn$, hollow m-$Pd_3Sn_2$, and commercial Pd/C, recorded in $N_2$-saturated aqueous solution containing 1.0 M KOH and 1.0 M glycerol at a scan rate of 50 $mV \cdot s^{-1}$.
Figure 12C:
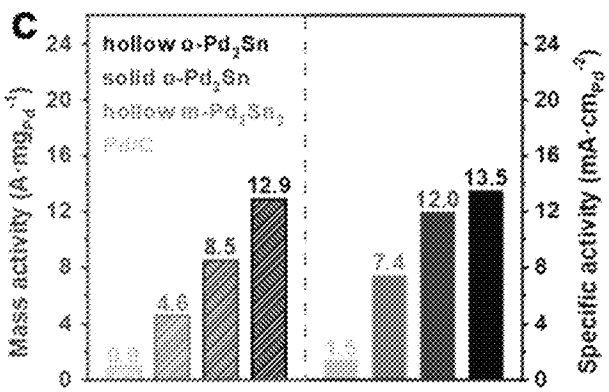
FIG. 12C illustrates mass activities (left panel) and specific activities (right panel) of hollow o-$Pd_2Sn$, solid o-$Pd_2Sn$, hollow m-$Pd_3Sn_2$, and commercial Pd/C at their corresponding peak potentials in the CV curves in FIG. 12B.

FIG. 12A shows the CV measurements of the aforementioned catalysts and commercial Pd/C in $N_2$-saturated aqueous electrolyte containing 1.0 M KOH. The obvious peaks in the potential range of 0.4-0.9 V (versus reversible hydrogen electrode (vs. RHE)) are attributed to the reduction of PdO. Among these catalysts, hollow o-$Pd_2Sn$ shows the strongest reduction peak of PdO, implying the exposure of more Pd active sites. According to the peak area of the reduction of PdO, the ECSAs were calculated. Hollow o-$Pd_2Sn$ shows an ECSA value of 95.6 $m^2 \cdot g_{Pd}^{-1}$, which is much higher than those of solid o-$Pd_2Sn$ (70.9 $m^2 \cdot g_{Pd}^{-1}$), hollow m-$Pd_3Sn_2$ (60.7 $m^2 \cdot g_{Pd}^{-1}$), and Pd/C (48.8 $m^2 \cdot g_{Pd}^{-1}$) (FIG. 13A). To assess the GOR performance of these catalysts, the CV measurements were carried out in $N_2$-saturated aqueous solution containing 1.0 M KOH and 1.0 M glycerol at 50 $mV \cdot s^{-1}$. As shown in FIG. 12B, hollow o-$Pd_2Sn$ exhibits the highest mass current in the potential range of 0.5-0.9 V (vs. RHE) among all catalysts. The mass activity of hollow o-$Pd_2Sn$ is determined to be 12.9 $A \cdot mg_{Pd}^{-1}$, which is 1.5, 2.8, and 14.3 times those of solid o-$Pd_2Sn$ (8.5 $A \cdot mg_{Pd}^{-1}$), hollow m-$Pd_3Sn_2$ (4.6 $A \cdot mg_{Pd}^{-1}$), and Pd/C (0.9 $A \cdot mg_{Pd}^{-1}$), respectively (FIG. 12C). As shown in Table 1, such high mass activity of hollow o-$Pd_2Sn$ puts it among the best of previously reported Pd-based electrocatalysts toward GOR.

TABLE 1

Summary of electrochemical GOR performances of Pd-based catalysts under alkaline conditions

| Catalyst | Electrolyte | Mass activity ($A \cdot mg_{noble\ metal}^{-1}$) |
|---|---|---|
| Hollow o-$Pd_2Sn$ NPs | 1.0M KOH + 1.0M glycerol | 12.9 |
| Solid o-$Pd_2Sn$ NPs | 1.0M KOH + 1.0M glycerol | 8.5 |
| Pd—Ru nanocages | 1.0M KOH + 1.0M glycerol | 6.3 |
| fcc-2H-fcc Au@Pd nanorods | 1.0M KOH + 0.1M glycerol | 1.87 |
| PdCu nanoparticles@ graphene | 1.0M KOH + 1.0M glycerol | 1.87 |
| $Pd_{50.2}Cu_{38.4}Pt_{11.4}$ twin icosahedrons | 1.0M KOH + 1.0M glycerol | 9.7 |
| PdBi nanosheet assemblies | 1.0M KOH + 1.0M glycerol | 3.04 |
| Pd/graphene foam | 1.0M KOH + 1.0M glycerol | 2.72 |
| $Pt_{32}Pd_{48}Ni_{20}$ nanosheets | 1.0M KOH + 0.1M glycerol | 5.63 |
| PdAuAg nanocages | 1.0M KOH + 1.0M glycerol | 5.68 |
| Pd—$WO_{2.75}$ nanobelts | 1.0M KOH + 1.0M glycerol | 4.9 |
| PdPt nanowire network | 1.0M KOH + 0.1M glycerol | 1.8 |
| PdPb alloy nanocubes | 1.0M KOH + 1.0M glycerol | 2.22 |
| PdMoSb trimetallene | 0.5M KOH + 0.5M glycerol | 2.19 |
| $Pd_{62}Au_{21}Ni_{17}$ nanosponges | 1.0M KOH + 0.1M glycerol | 3.3 |

Figure 13B:
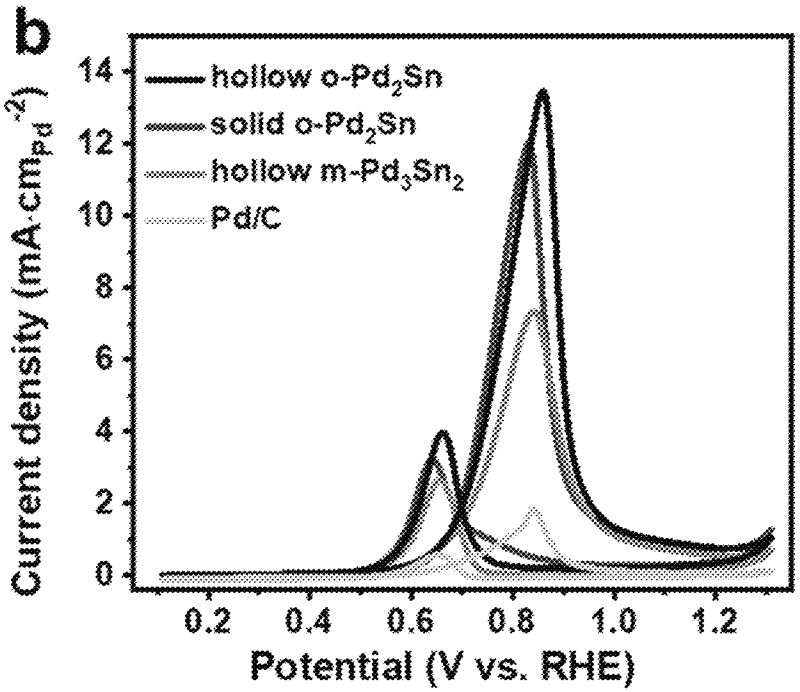
FIG. 13B illustrates ECSA-normalized CV curves of hollow o-$Pd_2Sn$, solid o-$Pd_2Sn$, hollow m-$Pd_3Sn_2$, and commercial Pd/C in $N_2$-saturated aqueous solution containing 1.0 M KOH and 1.0 M glycerol at a scan rate of 50 $mV \cdot s^{-1}$.
Figure 13A:
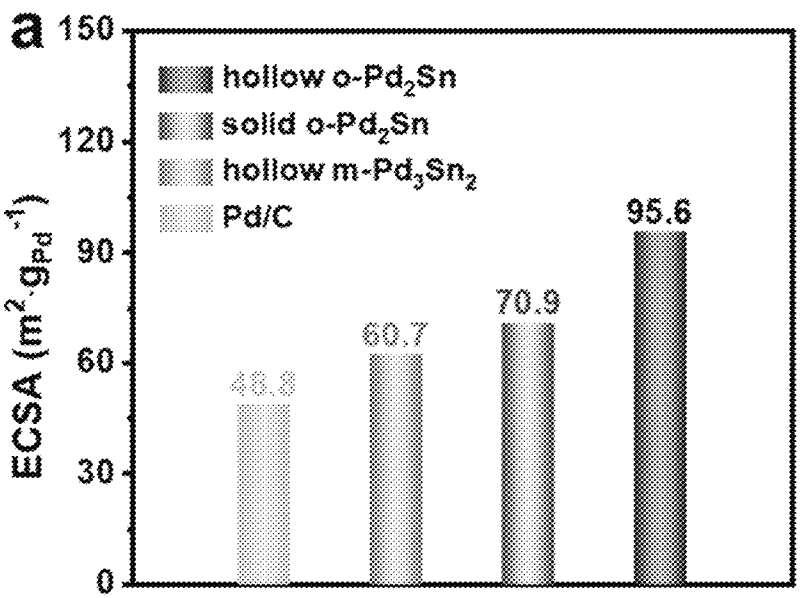
FIG. 13A illustrates the calculated electrochemically active surface areas (ECSAs) of hollow o-$Pd_2Sn$, solid o-$Pd_2Sn$, hollow m-$Pd_3Sn_2$, and commercial Pd/C based on the corresponding CV curves.

The mass currents of these catalysts were further normalized to their corresponding ECSAs for better comparison of their intrinsic activities, and the specific currents were shown in FIG. 13B. Notably, hollow o-$Pd_2Sn$ shows the highest specific activity of 13.5 $mA \cdot cm_{Pd}^{-2}$, which is 1.1, 1.8, and 9.0 times those of solid o-$Pd_2Sn$ (12.0 $mA \cdot cm_{Pd}^{-2}$), hollow m-$Pd_3Sn_2$ (7.4 $mA \cdot cm_{Pd}^{-2}$), and Pd/C (1.5 $mA \cdot cm_{Pd}^{-2}$), respectively (FIG. 12C).

Figure 12D:
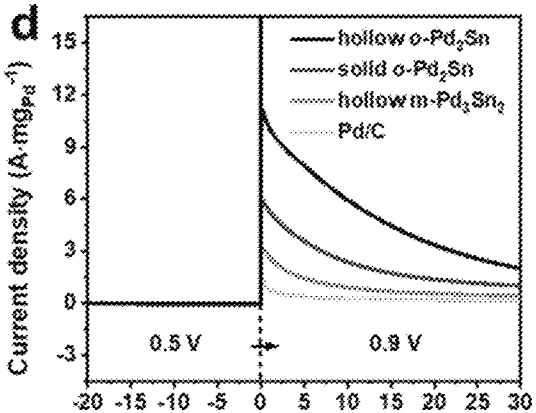
FIG. 12D illustrates current transients at 0.9 V (vs. reversible hydrogen electrode (RHE)) from an initial potential of 0.5 V (vs. RHE) of hollow o-$Pd_2Sn$, solid o-$Pd_2Sn$, hollow m-$Pd_3Sn_2$, and commercial Pd/C in aqueous solution containing 1.0 M KOH and 1.0 M glycerol.

To further compare the GOR activities, the current transients of these catalysts were performed using chronoamperometric measurements by instantaneously stepping from the potential of 0.5 V (vs. RHE) where the GOR was negligible to the potential of 0.9 V (vs. RHE) (typical potential for GOR). As shown in FIG. 12D, the initial sharp current transit represents the response of catalysts for the oxidation of glycerol, and the following current decay to a quasi-steady state originates from the accumulation and adsorption of poisoning species formed during the GOR process, such as strongly adsorbed CO ($CO_{ad}$), on the catalyst surface. Among all the as-synthesized catalysts, hollow o-$Pd_2Sn$ delivers the highest mass current for the oxidation of glycerol, which is in good agreement with the trend observed in CV curves (FIG. 12B).

Figure 12E:
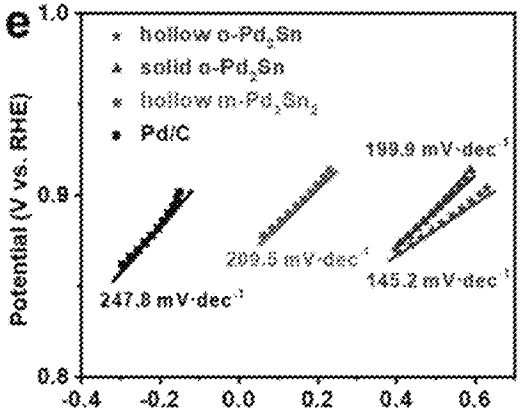
FIG. 12E illustrates Tafel plots of hollow o-$Pd_2Sn$, solid o-$Pd_2Sn$, hollow m-$Pd_3Sn_2$, and commercial Pd/C.

The Tafel analysis was conducted to further investigate the reaction kinetics on these catalysts (FIG. 12E). The hollow o-$Pd_2Sn$ exhibits a Tafel slope of 145.2 $mV \cdot dec^{-1}$, which is lower than those of solid o-$Pd_2Sn$ (199.9 $mV \cdot dec^{-1}$), hollow m-$Pd_3Sn_2$ (209.5 $mV \cdot dec^{-1}$), and Pd/C (247.8 $mV \cdot dec^{-1}$), indicating its fast reaction kinetics in GOR.

Figure 14A:
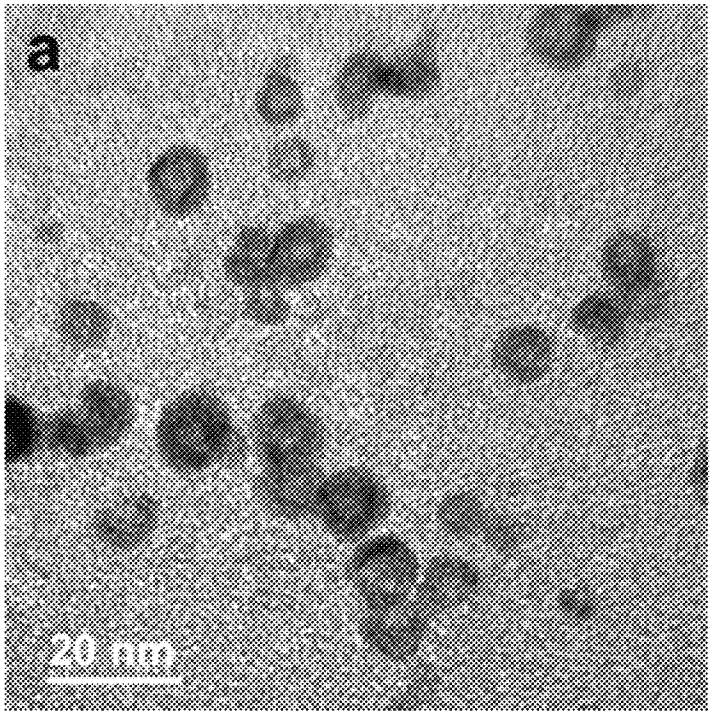
FIGS. 14A to 14B illustrate TEM image and HRTEM image of the hollow o-$Pd_2Sn$ catalyst after the durability test for GOR, respectively.
Figure 14B:
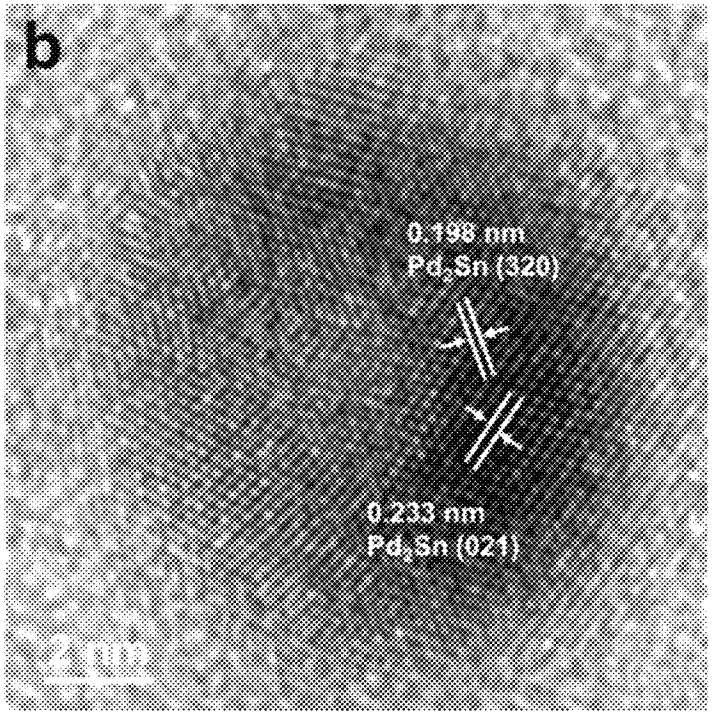

The stability of catalysts was also evaluated by the chronoamperometric measurements at 0.9 V (vs. RHE). After the durability tests of GOR process for 3,600 s, hollow o-$Pd_2Sn$ can still deliver the highest mass activity among these catalysts. Moreover, the morphology and phase of hollow o-$Pd_2Sn$ were well maintained after the durability test (FIGS. 14A and 14B), indicating the good structural stability of the catalyst.

The aforementioned results demonstrate that the hollow o-$Pd_2Sn$ catalyst shows better GOR performance than its solid counterpart, which could be attributed to the intrinsic advantages of hollow architecture. Furthermore, hollow o-$Pd_2Sn$ and solid o-$Pd_2Sn$ both exhibit superior GOR performances, including higher activity and better stability, to the hollow m-$Pd_3Sn_2$, suggesting the decisive role of the crystal phase of catalyst in modulating its catalytic performance.

The excellent GOR performance of hollow o-$Pd_2Sn$ could be originated from the following aspects. First, it is commonly accepted that alloying Pd with other transition metals like Sn could modify the electronic band structure of Pd-based nanomaterials, which contributes to the enhanced performance towards GOR. In this work, the change of electronic band structure of Pd in hollow o-$Pd_2Sn$ can be verified by the positive shift of binding energies in Pd 3d XPS spectrum as compared to those of pure Pd. Secondly, previous studies have revealed that noble metal-based intermetallic alloys could exhibit excellent catalytic performance because of their ordered atomic arrangements and unique electronic structures. In this work, the outstanding GOR performance of hollow o-$Pd_2Sn$ could also be originated from the unconventional orthorhombic intermetallic phase, which endows it with higher intrinsic catalytic activity, abundant active sites, and favorable reaction kinetics, as revealed by the highest specific activity, largest ECSA area, and lowest Tafel slope among all the as-prepared catalysts, respectively. Thirdly, catalysts with hollow architectures are featured with large specific surface area and enhanced utilization of noble metals, endowing them with promising catalytic performance, which also explains the better GOR activity of hollow o-$Pd_2Sn$ than that of solid o-$Pd_2Sn$. Therefore, the alloying effect of Pd and Sn, ordered intermetallic structure, and hollow architecture simultaneously contribute to the excellent GOR performance of the hollow o-$Pd_2Sn$ catalyst.

Operando IRRAS measurements

To provide deeper insight into the reaction mechanism during GOR on the hollow o-$Pd_2Sn$ catalyst, operando IRRAS studies were performed. Specifically, we conducted operando IRRAS measurements on the hollow o-$Pd_2Sn$ and Pd/C catalysts with potentials varying from 0.1 to 1.3 V (vs. RHE) in Ar-saturated aqueous solution containing 0.1 M KOH and 0.1 M glycerol.

Figure 15B:
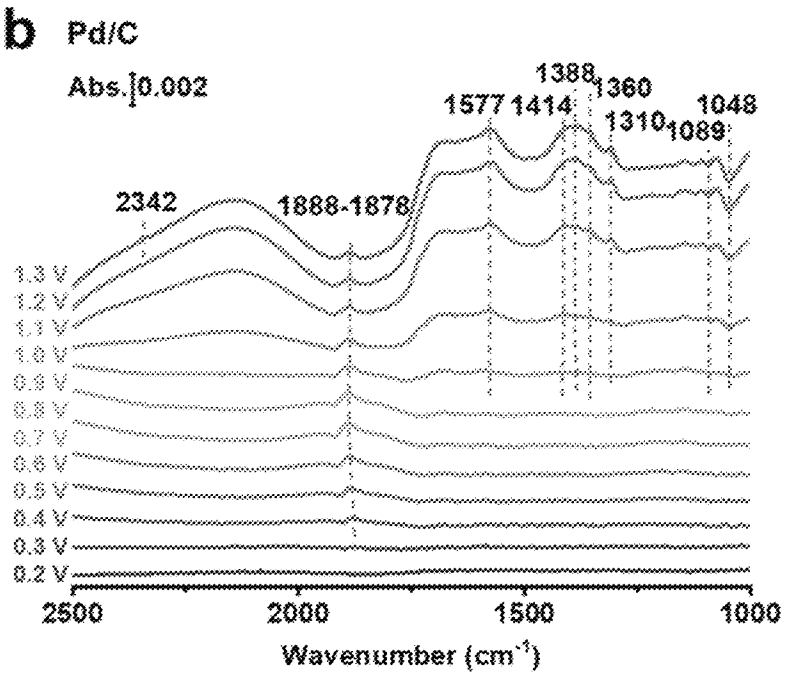
FIGS. 15A to 15F Operando IRRAS spectra recorded during the electrochemical GOR on the hollow o-$Pd_2Sn$ (FIGS. 15A, 15C and 15E) and commercial Pd/C (FIGS. 15B, 15D and 15F) in Ar-saturated aqueous solution containing 0.1 M KOH and 0.1 M glycerol.
Figure 15A:
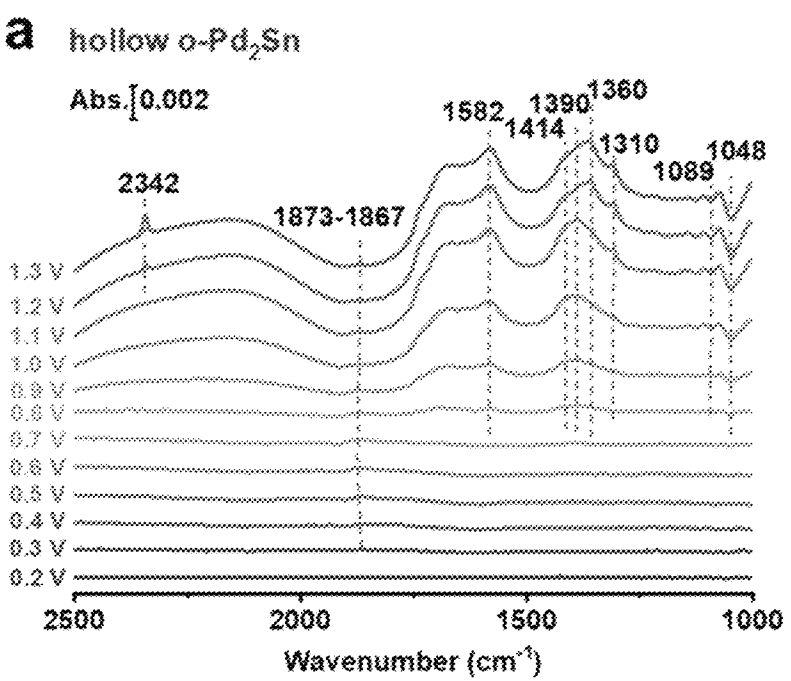

As displayed in FIGS. 15A and 15B, two downward bands located at 1048 and 1089 $cm^{-1}$ represent typical C—O vibration in alcohol molecules, confirming the consumption of glycerol reactants. The upward band at 1310 $cm^{-1}$ is a typical feature of C—O stretching of glyceraldehyde or glycerate ion, which is accompanied by two upward bands at around 1414 and 1580 $cm^{-1}$ that belong to the symmetric and asymmetric stretching of O—C—O, respectively, demonstrating the formation of carboxylate ions, including glycerate and acetate ions, during the reaction over both catalysts.

Figure 15C:
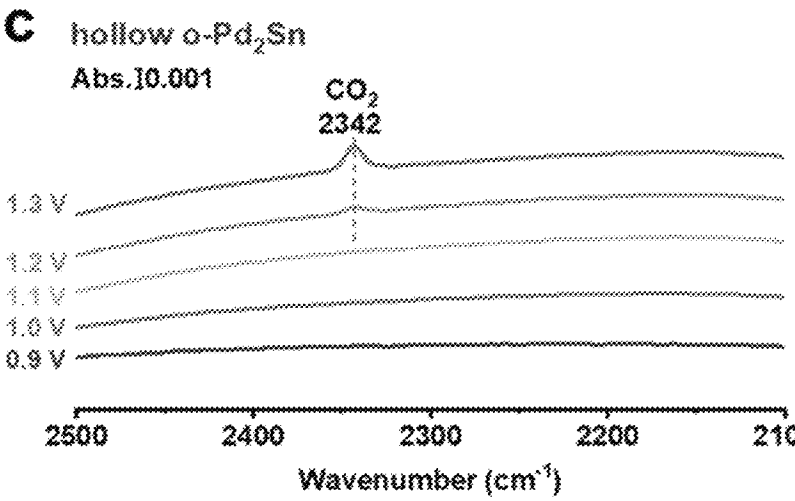
Figure 15D:
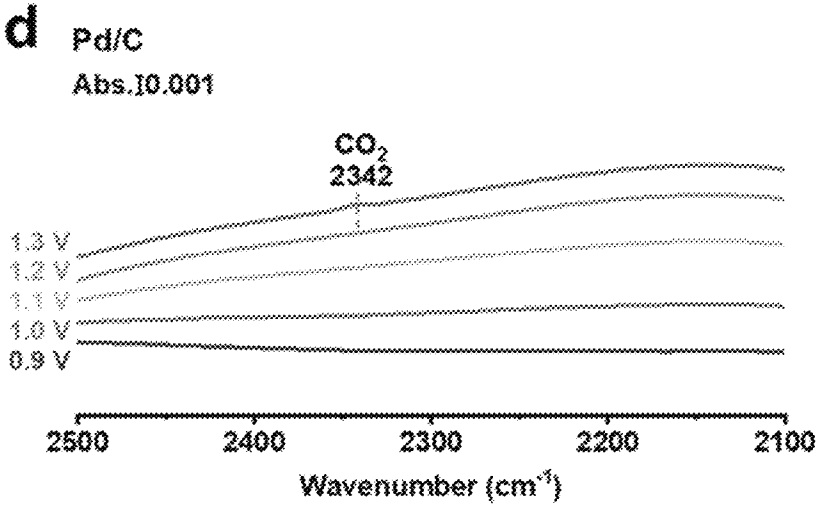

In addition, hollow o-$Pd_2Sn$ catalyst shows much weaker signals of triply bonded CO ($CO_T$) at 1873-1867 $cm^{-1}$ as compared to Pd/C (located at 1888-1878 $cm^{-1}$) from 0.3 to 1.3 V (vs. RHE), suggesting a better anti-poisoning ability to *CO. Notably, the signal of $CO_2$ is also detected at 2342 $cm^{-1}$ on both catalysts (FIGS. 15C and 15D). In comparison, the $CO_2$ band on hollow o-$Pd_2Sn$ appears from a lower potential (1.2 V vs. RHE) than that on Pd/C (1.3 V vs. RHE), and the band intensity ratio between $CO_2$ (2342 $cm^{-1}$) and carboxylate ions (1414 $cm^{-1}$) is also higher over hollow o-$Pd_2Sn$.

Figure 15E:
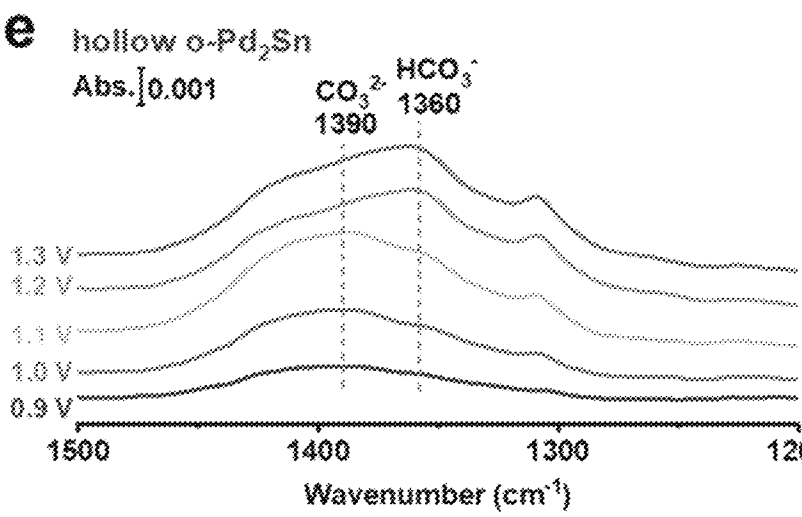
Figure 15F:
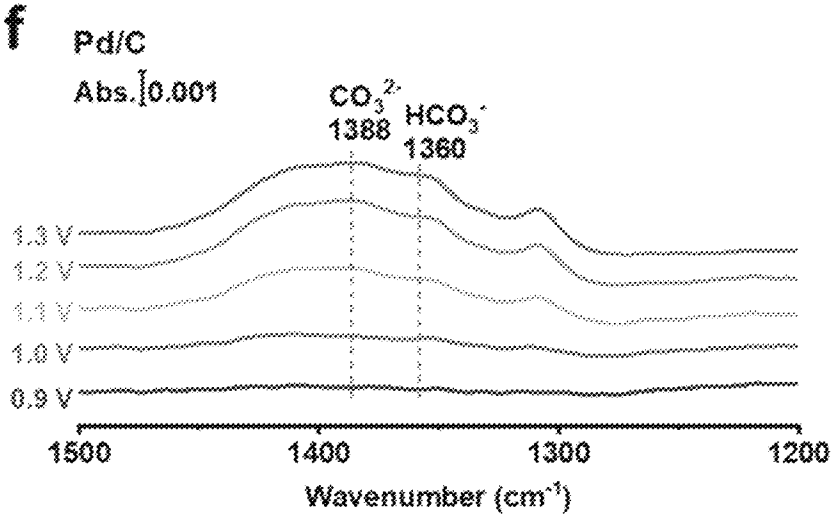
Figure 16:
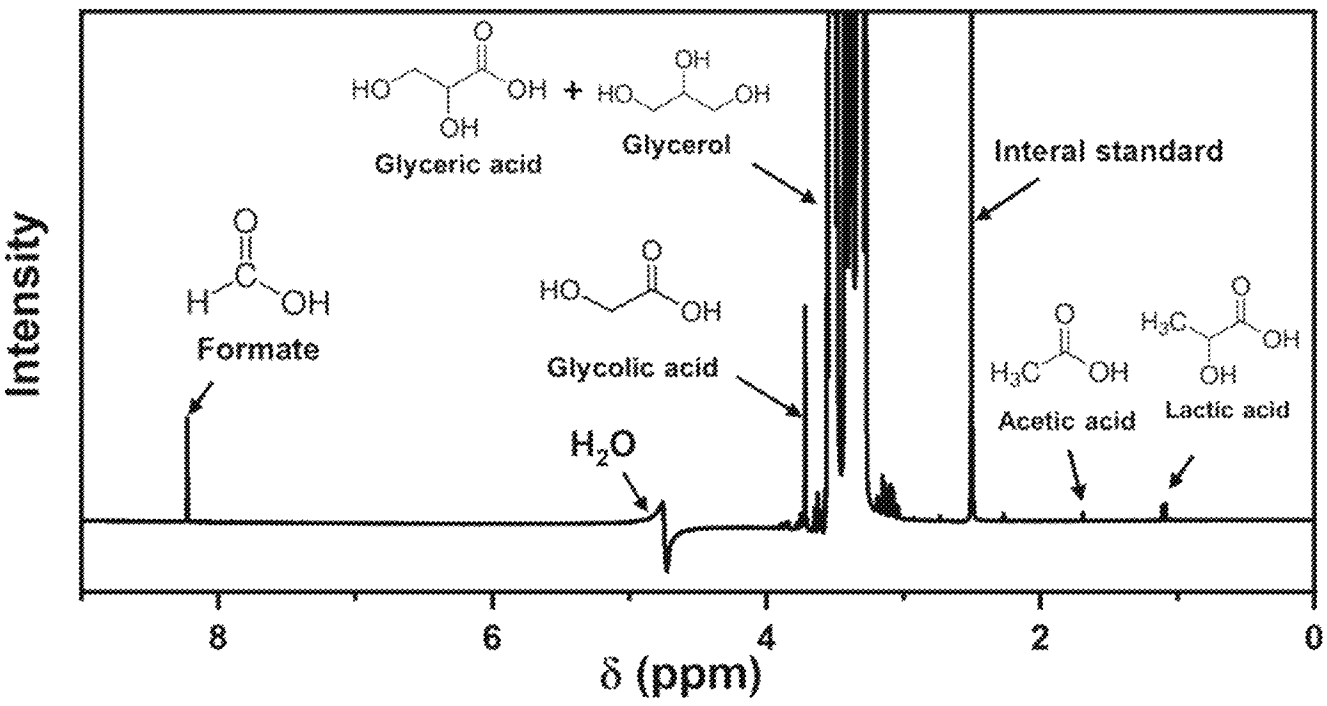
FIG. 16 illustrates proton nuclear magnetic resonance ($^1H$ NMR) measurements of the products after GOR process on the hollow o-$Pd_2Sn$ catalyst. DMSO was added as an internal standard. The water peak at around 4.7 ppm is suppressed with presaturation.

These results indicate that hollow o-$Pd_2Sn$ is more capable of breaking the C—C bond for complete oxidation of glycerol to generate $CO_2$ compared with Pd/C. Moreover, two bands at around 1390 and 1360 $cm^{-1}$ are corresponding to the existence of $CO_3^{2-}$ and $HCO_3^-$, respectively, which are sequentially generated from the continuous reaction between produced $CO_2$ and the alkaline electrolyte. As shown in FIG. 15E, the band intensity of $HCO_3^-$ can even surpass that of $CO_3^{2-}$ on hollow o-$Pd_2Sn$ at high potentials of 1.2 to 1.3 V (vs. RHE), while the $CO_3^{2-}$ band was stronger than $HCO_3^-$ on Pd/C at all potentials (FIG. 15F), revealing the more significant generation of $CO_2$ and thereby a stronger C—C cleavage capability of hollow o-$Pd_2Sn$ catalyst.

Figure 18:
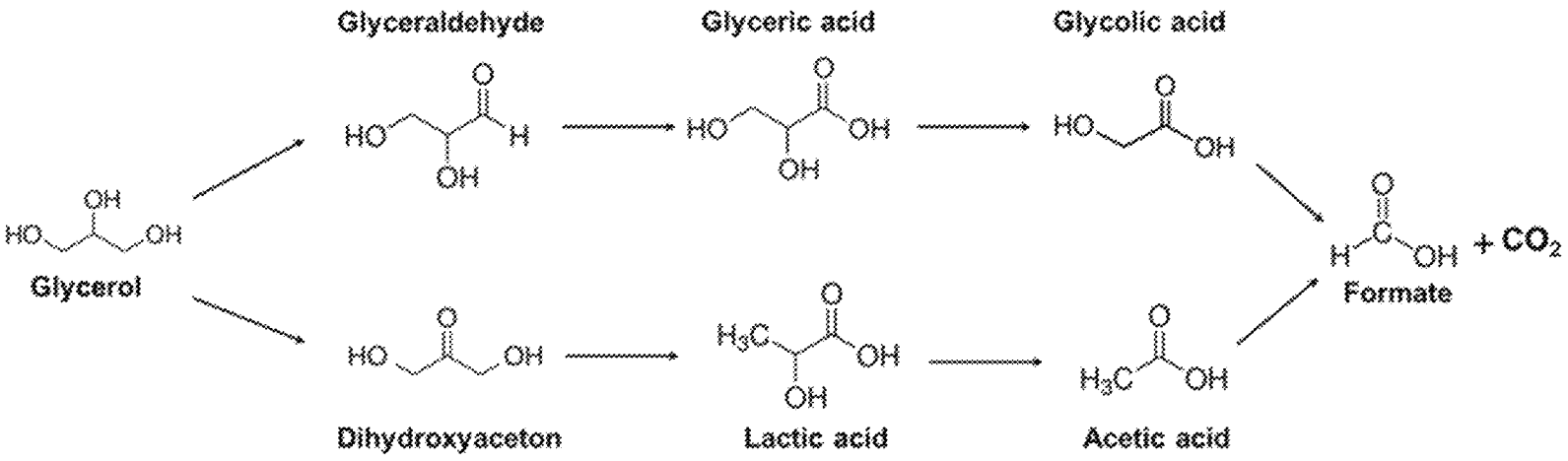
FIG. 18 illustrates two pathways involved in a reaction mechanism of GOR in alkaline media.

The products after GOR process over hollow o-$Pd_2Sn$ were further analyzed by $^1H$ NMR to clarify the reaction pathway. The co-existence of formate, acetic acid, lactic acid, glycolic acid, glycerate, and the remaining glycerol was detected in the products (FIG. 16 and FIGS. 17A-17F). Based on the IRRAS and $^1H$ NMR results, a reaction mechanism involving two pathways for GOR in this work is proposed and displayed in FIG. 18.

The embodiments may be chosen and described in order to best explain the principles of the invention and its practical application, thereby enabling others skilled in the art to understand the invention for various embodiments and with various modifications that are suited to the particular use contemplated. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations. While the apparatuses disclosed herein have been described with reference to particular structures, shapes, materials, composition of matter and relationships . . . etc., these descriptions and illustrations are not limiting. Modifications may be made to adapt a particular situation to the objective, spirit and scope of the present disclosure. All such modifications are intended to be within the scope of the claims appended hereto.

What is claimed is:

1. A method for synthesizing intermetallic nanoparticles, comprising:

preparing noble-metal nanoparticle seeds;

dispersing a metal precursor into the noble-metal nanoparticle seeds to form a first mixture;

adding the first mixture into an organic solvent to form a first solution;

sonicating the first solution at room temperature;

subjecting the first solution to a heat treatment under $N_2$ atmosphere to render a second solution;

cooling the second solution naturally to room temperature;

adding ethanol to the second solution to form a third solution; and collecting the intermetallic nanoparticle from the third solution by centrifugation.

2. The method of claim 1, wherein a heating temperature of the heat treatment ranges from 200° C. to 300° C.; and a heating time of the heat treatment is longer than 1 hour.

3. The method of claim 2, wherein the heating temperature is 250° C.; and the first heating time is 3 hours.

4. The method of claim 1, wherein the noble-metal nanoparticle seeds are made of noble-metal nanoparticles with hexagonal close-packed phase such that the synthesized intermetallic nanoparticles are hollow intermetallic nanoparticles.

5. The method of claim 4, wherein the noble-metal nanoparticles with hexagonal close-packed phase are Pd nanoparticles and the metal precursor is a Sn precursor such that the synthesized intermetallic nanoparticles are hollow Pd—Sn intermetallic nanoparticles.

6. The method of claim 5, wherein a weight ratio of the Sn precursor to the Pd nanoparticles ranges from 3:2 to 4:1 such that the synthesized Pd—Sn intermetallic nanoparticles are hollow orthorhombic $Pd_2Sn$ alloy nanoparticles.

7. The method of claim 6, wherein the weight ratio of the Sn precursor to the Pd nanoparticles is 12:7.

8. The method of claim 7, wherein the synthesized hollow orthorhombic $Pd_2Sn$ alloy nanoparticles have an average particle size of 10.2±1.8 nm and an average void size of 5.2±1.1 nm.

9. The method of claim 5, wherein a weight ratio of the Sn precursor to the Pd nanoparticles ranges from 7:1 to 10:1 such that the synthesized Pd—Sn intermetallic nanoparticles are hollow monoclinic $Pd_3Sn_2$ alloy nanoparticles.

10. The method of claim 9, wherein the weight ratio of the Sn precursor to the Pd nanoparticles is 60:7.

11. The method of claim 10, wherein the synthesized hollow monoclinic $Pd_3Sn_2$ alloy nanoparticles have an average particle size of 11.5±2.9 nm and an average void size of 5.5±2.9 nm.

12. The method of claim 1, wherein the noble-metal nanoparticle seeds are made of noble-metal nanoparticles with face-centred cubic phase such that the synthesized intermetallic nanoparticles are solid intermetallic nanoparticles.

13. The method of claim 12, wherein the noble-metal nanoparticles with face-centred cubic phase are Pd nanoparticles and the metal precursor is a Sn precursor such that the synthesized intermetallic nanoparticles are solid Pd—Sn intermetallic nanoparticles.

14. The method of claim 13, wherein a weight ratio of the Sn precursor to the Pd nanoparticles ranges from 3:2 to 4:1 such that the synthesized Pd—Sn intermetallic nanoparticles are solid orthorhombic $Pd_2Sn$ alloy nanoparticles.

15. The method of claim 14, wherein the weight ratio of the Sn precursor to the Pd nanoparticles is 12:7.

16. The method of claim 15, wherein the synthesized solid orthorhombic $Pd_2Sn$ alloy nanoparticles have an average particle size of 7.4±0.7 nm.

17. A method of using intermetallic nanoparticles made by the method of claim 1 as catalysts for an electrochemical glycerol oxidation reaction.

* * * * *